United States Patent [19]

Usui et al.

[11] Patent Number: 4,817,065

[45] Date of Patent: Mar. 28, 1989

[54] BATTERY-POWERED TYPE COMPACT ELECTRONIC EQUIPMENT

[75] Inventors: Norihisa Usui; Hisashi Hihara, both of Tokyo, Japan

[73] Assignee: Casio Computer Co., Ltd., Tokyo, Japan

[21] Appl. No.: 122,633

[22] Filed: Nov. 9, 1987

Related U.S. Application Data

[63] Continuation of Ser. No. 840,949, Mar. 18, 1986, abandoned.

[30] Foreign Application Priority Data

Mar. 20, 1985 [JP] Japan ..... 60-40703[U]
Sep. 10, 1985 [JP] Japan ..... 60-138407

[51] Int. Cl.[4] ..... G04B 1/00
[52] U.S. Cl. ..... 368/62; 368/281

[56] References Cited

U.S. PATENT DOCUMENTS

| | | | |
|---|---|---|---|
| 3,977,176 | 8/1976 | Murakami et al. | 368/282 |
| 4,023,347 | 5/1977 | Haber | 368/282 |
| 4,194,355 | 3/1980 | Nishida | 368/282 |
| 4,255,801 | 3/1981 | Ode et la. | 368/282 |
| 4,412,751 | 11/1983 | Jeannet et al. | 368/282 |
| 4,419,770 | 12/1983 | Yagi et al. | 368/10 |
| 4,427,303 | 1/1984 | Matthias | 368/282 |
| 4,586,827 | 5/1986 | Hirsch et al. | 368/282 |

FOREIGN PATENT DOCUMENTS

| | | | |
|---|---|---|---|
| 6380 | 1/1982 | Japan | 368/282 |
| 59-35823 | 3/1984 | Japan . | |
| 59-115374 | 3/1984 | Japan . | |
| 59-115376 | 3/1984 | Japan . | |
| 1555848 | 11/1979 | United Kingdom | 368/282 |

*Primary Examiner*—Bernard Roskoski
*Attorney, Agent, or Firm*—Frishauf, Holtz, Goodman & Woodward

[57] ABSTRACT

Battery-powered type compact electronic equipment comprises circuit members for performing various functions, a function data display device for displaying function data executed by the circuit members, and a case integrally formed of a synthetic resin and provided with a flat portion and an inclined portion inclined at a predetermined angle with respect to the flat portion, the case being adapted to store the circuit members and the function data display device therein. The equipment may further comprises bands integrally formed with the case, the bands being adapted to cause the case to fit on a part of surface of a user's body.

30 Claims, 20 Drawing Sheets

BATTERY-POWERED TYPE COMPACT ELECTRONIC EQUIPMENT

This application is a continuation, of application Ser. No. 840,949, now abandoned, filed Mar. 18, 1986.

BACKGROUND OF THE INVENTION

The present invention relates to battery-powered type electronic equipment such as compact electronic equipment with various functions such as a time display function, an alarm function and a calculation function.

Wristwatches are known as conventional electronic equipment of this type. Such a wristwatch (to be referred to as a multifunction wristwatch hereinafter) includes a circuit means for performing a time signal generation function and other functions; a function data display means for displaying function data such as time, calculation processes and their result, executed by the circuit means; and a case housing the circuit means and the function data display means therein. A case of a conventional multifunction wristwatch has a flat shape, as shown in Japanese Utility Model Publication No. 59-35823. A liquid crystal display as the function data display means and pushbutton switches as the circuit operation means are arranged on the flat case.

The more types of functions executed by the circuit means, the larger the area of the circuit operation means and the function data display means is. The case size and its weight are thus increased. In order to decrease the case size, the size of the circuit operation means and the function data display means must be decreased. However, it is difficult to manipulate a small circuit operation means, and it is difficult to read data displayed on a small function data display means. Thus, the miniaturization of these means is limited. In particular, even if the number of functions executed by the circuit means is to be increased, the number of circuit operation means, such as pushbutton switches, that can be fitted in the case is limited. Furthermore, when both the circuit operation means and the function data display means are arranged on the upper surface of the flat case, the hand or fingers of the user cover the function data display means upon operation of the circuit operation means. A large case cannot be worn comfortably on the wrist of a user. Furthermore, when the user inclines the wristwatch so as to properly operate the circuit operation means, the readability of data displayed on the function data display means is degraded. Likewise, when the user's wrist is inclined to allow easy reading of the data displayed on the function data display means, this leads to difficulty in operating the circuit operation means.

In the conventional multifunction wristwatch, the case and the watch band are independent from each other. The band is coupled to the case through a pushpin or spring-bar. With this arrangement, it is difficult to obtain relatively high coupling strength between the case and the band. In addition, the overall number of components in the multifunction wristwatch is increased, resulting in an increase in fabrication cost and cumbersome assembly.

SUMMARY OF THE INVENTION

The present invention has been made in consideration of the above situation, and has as its first object to provide compact electronic equipment wherein a case thereof is relatively compact and lightweight to simplify its fabrication, and easy operation of the circuit operation means can be performed while simultaneously good reading data displayed on the function data display means.

In addition to the first object, it is a second object of the present invention to provide compact electronic equipment wherein coupling strength between a wristwatch case and band means for fixing to the wrist of a user can be increased, but a required number of coupling components can be decreased, thereby decreasing the fabrication cost and simplifying assembly.

In order to achieve the first object of the present invention, there is provided battery-powered type compact electronic equipment, comprising: circuit means for performing the various functions, function data display means for displaying function data executed by the circuit means, and a case integrally formed of a synthetic resin and provided with a flat portion and an inclined portion inclined at a predetermined angle with respect to the flat portion, the case being adapted to store the circuit means and the function data display means therein.

Since the case housing the circuit means and the function data display means has the flat and inclined portions, an increase in case surface area for arranging the function data display means and the circuit operation means does not increase the size of the case itself since the case is bent. The bent case can thus easily fit on a portion of the surface of the user's body. Since the case is an integral plastic body, it can be easily manufactured, even though it is bent as described above. Since the case having the flat and inclined portions, the function data display means such as a liquid crystal display may be arranged in one of the flat and inclined portions, and the circuit operation means, as at least one of the circuit means, such as at least one pushbutton switch or a key pad with at least one switch for controlling the circuit means may be arranged in the other of the flat and inclined portions. Therefore, when compared with conventional electronic equipment wherein the circuit operation means and the function data display means are arranged on a single flat surface of the case, easy operation of the circuit operation means and easy reading of data displayed on the function data display means can be performed at the same time.

In the compact electronic equipment with the arrangement described above, it is preferable that the case has a recess for storing the circuit means and the function data display means, the recess is covered with a cover manufactured separately from the case, and a sealing member is arranged in the recess and is pressed by the cover to seal the recess, the sealing member being made of an elastic material and being pressed by the cover to elastically hold at least the function data display means in the recess.

With this arrangement, an independent fixing member such as a screw for fixing at least the function data display means in the recess can be eliminated. Therefore, the fabrication cost of compact electronic equipment can be decreased, and its assembly can be simplified.

In a compact electronic wristwatch featuring the above arrangement, when the function data display means is held in one of the flat and inclined portions of the case, and at least one constituting component of the circuit means is held in the other of the flat and inclined portions, the constituting component can be a battery for supplying power to the circuit means.

With the above arrangement, therefore, the case thickness can be decreased as compared with an arrangement wherein the battery overlays the function data display means.

In the compact electronic equipment featuring the arrangement described above, when the function data display means is held in one of the flat and inclined portions of the case, at least one constituting component of the circuit means is held in the other of the flat and inclined portions, and the constituting component is a circuit operation switch means for controlling the operation of the circuit means, the circuit operation switch means can be constituted by at least one pushbutton switch or a key pad with at least one switch.

When the circuit operation switch means is at least one pushbutton switch, the operation section of the pushbutton switch can be integrally formed with the case by using plastic with elasticity.

Since the operation section of the pushbutton switch formed as described above simplify the construction of the pushbutton switch, the fabrication or manufacturing cost of the pushbutton switch (hence that of the compact electronic equipment of the present invention) can be decreased, and assembly can be simplified.

If the circuit operation switch means is a plurality of pushbutton switches, it is preferable that the operation sections of the pushbutton switches are formed on the outer surface of the case so as to differ the heights of the operation sections from the outer surface of the case, each other.

The operation sections of the plurality of pushbutton switches formed as described above not only simplifies the construction of the pushbutton switch but also eliminates accidental depression of the two adjacent pushbutton switches when the pushbutton switches are operated.

In the compact electronic equipment of the present invention, the constituting component of the circuit means held in the other of the flat and inclined portions of the case may be circuit operation switch means for controlling operation of the circuit means, and a battery for supplying power to the circuit means.

The advantages obtained from a case in which the function data display means such as a liquid crystal display is arranged in one of the flat and inclined portions and the circuit operation switch means for controlling operation of the circuit means is arranged in the other of the flat and inclined portions, and the advantages obtained from a case in which the function data display means such as a liquid crystal display is arranged in one of the flat and inclined portions of the case and a battery for supplying power to the circuit means is arranged in the other of the flat and inclined portions have already described above.

When the circuit operation switch means and the battery are arranged in the other of the flat and inclined portions of the case and the circuit operation switch means is at least one pushbutton switch, it is preferable that the circuit operation switch means is arranged in the other of the flat and inclined portions of the case so as not to overlay the battery.

With the above construction, even if the operation control switch means is a pushbutton switch, a thickness of which is larger than that of the key pad, the overall thickness of the case can be decreased as compared with an arrangement wherein the battery is arranged in one of the flat and inclined portions so as to overlay the function data display means. Easy reading of data displayed on the function data display means and easy operation of the circuit operation switch means can be simultaneously achieved.

In the compact electronic equipment of the present invention, when the function data display means such as a liquid crystal display is arranged in one of the flat and inclined portions of the case, the constituting component including the battery of the circuit means is arranged in the other of the flat and inclined portion, and the circuit means has a circuit board arranged in either the flat or inclined portion, it is preferable that the battery is arranged to be inclined with respect to the circuit board.

With this arrangement, the battery can be replaced along a direction crossing the function data display means such as a liquid crystal display arranged in either the flat or inclined portion of the case. The battery replacement in this direction can be easily performed as compared with battery replacement in a direction perpendicular to the flat or inclined portion.

In order to achieve the second object of the present invention, there is provided battery-powered type compact electronic equipment, comprising circuit means for performing the various functions, function data display means for displaying function data executed by the circuit means, a case integrally formed of a synthetic resin and provided with a flat portion and an inclined portion inclined at a predetermined angle with respect to the flat portion, the case being adapted to store the circuit means and the function data display means therein, and band means integrally formed with the case, the band means being adapted to cause the case to fit on a part of surface of a user's body.

In the compact electronic equipment for achieving the second object of the present invention, the case of the compact electronic equipment for achieving the first object of the present invention is formed integrally with band means for fixing the case on a part of the user's body so as to fit the case on the part of surface of the user's body.

The compact electronic equipment for achieving the second object of the present invention can achieve the first object of the present invention described above, and can increase coupling strength between the band means compared with that of the conventional band-case coupling using a push-pin or the like. In addition, the required number of coupling parts can be decreased, thus decreasing the fabrication or manufacturing cost and simplifying assembly.

In the compact electronic equipment for achieving the second object, when the case has a recess for storing the circuit means and the function data display means, the band means can constitute part of the recess together with either the flat or inclined portion of the case.

When the band means and the case together constitute part of the recess, described above, the coupling structure therebetween inevitably provides a high coupling strength.

In the above arrangement, when the constituting component of the circuit means arranged in the other of the flat and inclined portions of the case has the circuit operation switch means for controlling the operation of the circuit means, the operation section of the circuit operation switch means may be formed of an elastic plastic material to be integral with the band means.

The operation section of the circuit operation switch means formed as described above simplifies the construction of the circuit operation switch means. Therefore, the fabrication or manufacturing cost of the circuit operation switch means (hence that of the compact electronic equipment of the present invention) can be decreased, and assembly can be simplified.

In the compact electronic equipment of the present invention, the circuit means may have a time signal generation function, and the compact electronic equipment may constitute a timepiece.

DESCRIPTION OF THE PREFERRED EMBODIMENTS

A first embodiment exemplifying a battery-powered type wristwatch according to the present invention will be described with reference to FIGS. 1 to 3.

Figure 1:
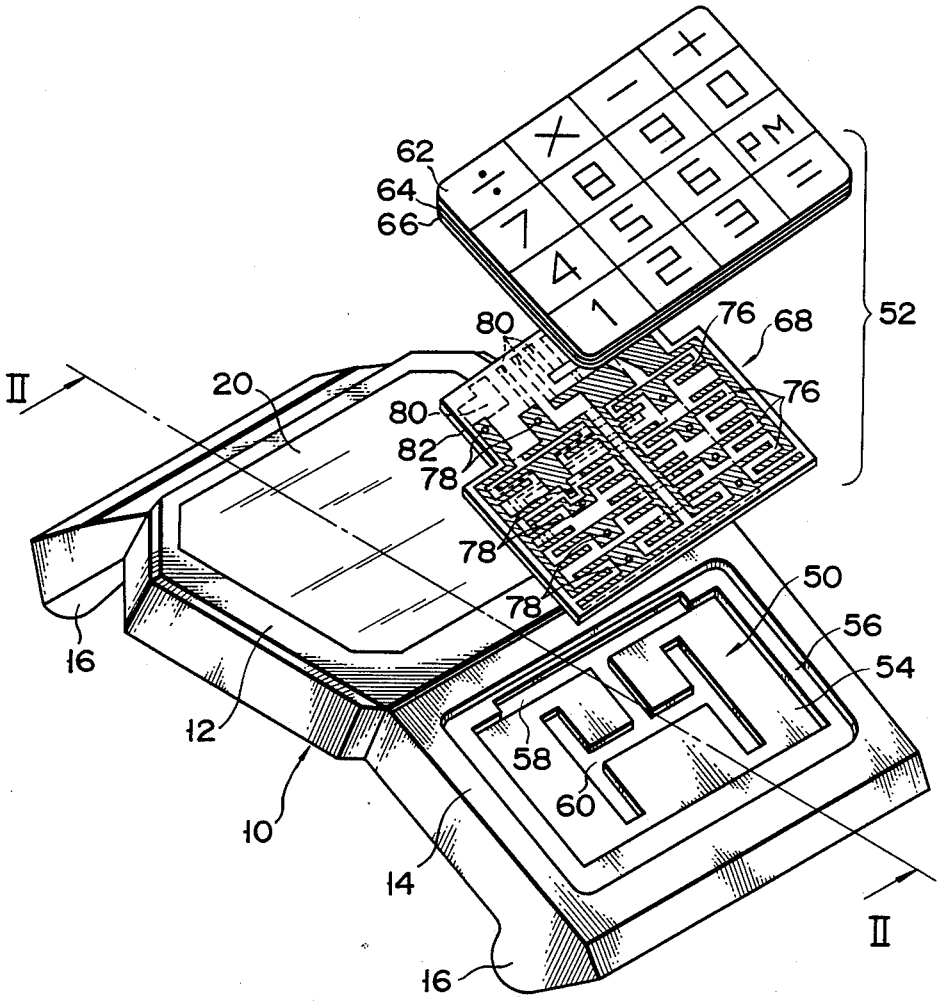
FIG. 1 is an exploded perspective view of a battery-powered type wristwatch according to an embodiment of the present invention.
Figure 2:
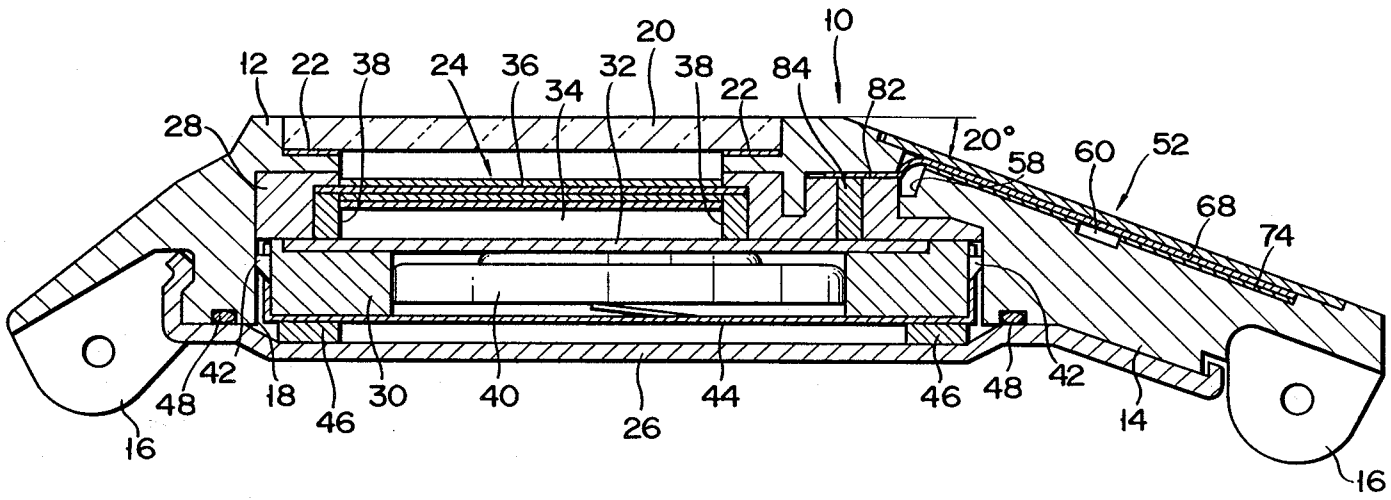
FIG. 2 is a sectional view of the wristwatch of FIG. 1 taken along the line II—II thereof.
Figure 3:
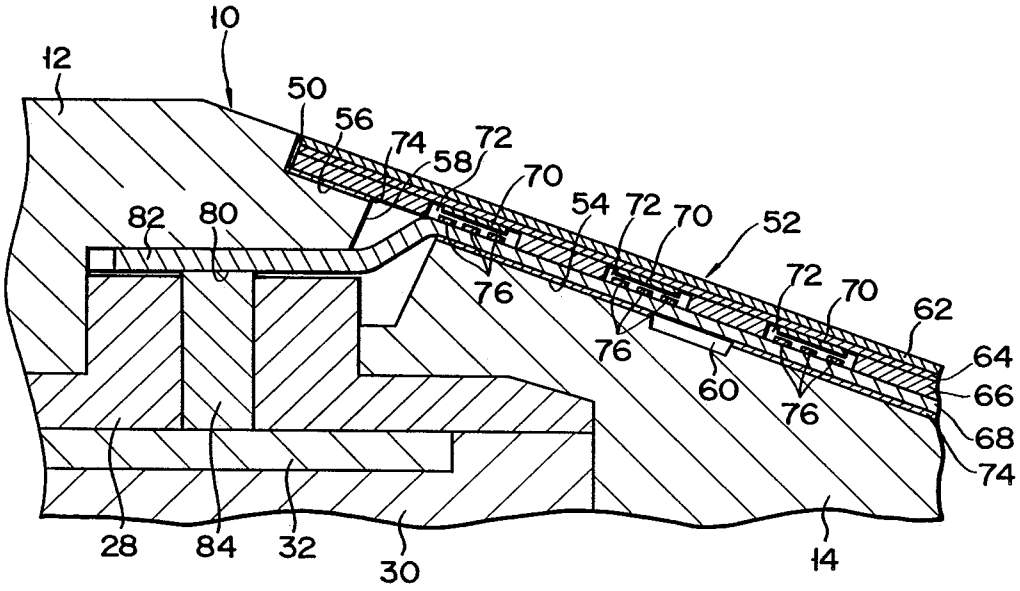
FIG. 3 is a partial enlarged view of the wristwatch in FIG. 2.

FIG. 1 is an exploded perspective view showing the main part of the battery-powered type wristwatch with a calculator function according to the first embodiment, FIG. 2 is a sectional view of the wristwatch of FIG. 1 taken along the line II—II thereof, and FIG. 3 is an enlarged view showing the main part of FIG. 2. Wristwatch case 10 is formed by injection molding and has flat portion 12 and inclined portion 14 inclined downward at a predetermined angle (about 20 degrees) with respect to flat portion 12. Band attaching portions 16 for a wristwatch band (not shown) are formed at free ends of portions 12 and 14, respectively.

Glass plate 20 is adhered by two-sided adhesive tape 22 to cover an upper opening of recess 18 extending through flat portion 12 and part of inclined portion 14, as shown in FIG. 2. Module 24 is mounted inside recess 18 and extends from flat portion 12 to inclined portion 14. A lower opening of recess 18 is covered with back cover 26.

Module 24 is a unit consisting of a circuit means for performing timepiece and calculator functions and a function data display means for displaying function data executed by the circuit means. Module 24 has circuit board 32 clamped between upper and lower housings 28 and 30. LSI 34 is arranged on the upper surface of board 32. Liquid crystal display device 36 as the function data display means is arranged above LSI 34, and is electrically connected to board 32 through interconnector 38 to display data such as time and values calculated by the circuit means. Device 36 is located below plate 20. The circuit means also has battery 40 arranged under board 32. Battery 40 is located on the lower surface of housing 30 and is pressed by plate 44 locked by projections 42 fixed on the side walls of housing 30.

Module 24 is pressed in recess 18 by module press ring 46 of cover 26 which abuts against plate 44 from the lower direction. Cover 26 is attached to the lower portion of wristwatch case 10 through waterproof ring 48.

Recess 50 is formed in the upper surface of inclined portion 14 of case 10, as shown in FIG. 1. Key pad 52 as the circuit operation means is arranged in recess 50. Recess 50 is formed in substantially the entire upper surface of inclined portion 14. Shallow stepped portion 56 is formed along the entire edge of bottom surface 54 of recess 50. Slit-like elongated through hole 58 is formed in portion 56 at the side of flat portion 12. As shown in FIG. 2, hole 58 communicates recess 50 with recess 18, and key pad 52 partially extends into recess 18 through hole 58. H-shaped groove 60 is formed in bottom surface 54 of recess 50, and the center of groove 60 is guided to hole 58. Groove 60 eliminates air between the lower surface of key pad 52 and surface 54 when key pad 52 is placed on surface 54.

As shown in FIGS. 1 and 3, key pad 52 consists of printed sheet 62, upper contact sheet 64, spacer 66 and lower contact sheet 68, which are stacked downward in the order named. Key pad 52 is flexible.

More specifically, sheet 62 is made of a flexible transparent film. Key symbols (e.g., 1 to 0, +, −, × and ÷)

required for calculations or the like are printed on the lower surface thereof, so that the user can read them, as shown in FIG. 1. Movable contacts 70, respectively corresponding to the various key symbols of sheet 62, are formed on the lower surface of sheet 64 adhered to the lower surface of sheet 62, as shown in FIG. 3. Upon depression of a given key symbol, corresponding movable contact 70 is flexed downward. Spacer 66 is a sheet with openings 72 respectively corresponding to contacts 70 of sheet 64. The upper surface of spacer 66 is adhered to the lower surface of sheet 64, and the edge of the lower surface thereof is adhered to portion 56 of recess 50.

Sheet 68 is located under spacer 66, and the lower surface of sheet 68 is adhered by two-sided adhesive tape 74 or the like to surface 54 of recess 50. Stationary contacts 76 are located at positions corresponding to openings 72 of spacer 66 on the upper surface of sheet 68 and are separated from contacts 70 of sheet 64, as shown in FIGS. 1 to 3. When the user depresses a desired one key symbol of sheet 62, the corresponding movable contact 70 of sheet 64 is flexed and is brought into contact with corresponding stationary contact 76 through corresponding opening 72 of spacer 66. Contacts 76 are connected to terminals 80 through conductor members formed in through holes 78 formed in sheet 68. Terminals 80 are arranged on the lower surface of extended portion 82 of sheet 68 inserted in hole 58 of recess 50. As best shown in FIG. 3, portion 82 of sheet 68 is pressed against the inner surface of recess 18 of case 10 by housing 28 of module 24. Terminals 80 formed on the lower surface of extended portion 82 are electrically connected to board 32 through interconnector 84.

In the battery-powered type wristwatch having the arrangement described above, time is normally displayed on device 36 of module 24. However, when the user sets a calculator mode with a selection switch (not shown) and depresses a key symbol of key pad 52, corresponding calculation data is supplied to LSI 34 and device 36. The calculation and result data are sequentially displayed on device 36.

Since case 10 of the battery-powered type wristwatch has flat portion 12 and inclined portion 14 inclined downward at the predetermined angle, the overall surface area of case 1 can be increased without increasing the planar area thereof. In addition, part of module 24, most of which is arranged in flat portion 12, is also arranged in inclined portion 14 so that case 10 can be made more compact.

The dimensions of the battery-powered type wristwatch as a trial product are given as follows. Flat portion 12 of case 10 has an overall length of 22 to 25 mm, inclined portion 14 has an overall length of 18 to 20 mm, module 24 has an overall length of 26 to 30 mm, and case 10 has an overall thickness of about 4 to 6 mm. As compared with a conventional battery-powered type wristwatch, in which the liquid crystal display device and the key pad are arranged on the single flat surface of the case, having the same functions as those of the sample wristwatch according to the first embodiment, the wristwatch of the present invention could be made more compact.

In the battery-powered type wristwatch of the first embodiment, since key pad 52 is arranged in inclined portion 14 of case 10, data displayed on device 36 arranged in flat portion 12 is not covered by a key pad operation member such as a finger or pencil upon operation of key pad 52. In addition, keys in key pad 52 can be easily depressed.

An inclination angle of 20 degrees of portion 14 with respect to flat portion 12 allows an ideal fit between case 10 and the user's wrist. When the predetermined angle is changed, case 10 can be an ideal fit on another body portion, such as an upper arm or an ankle.

Since groove 60 is formed in surface 54 of recess 50, air bubbles are not formed between surface 54 and sheet 68 when sheet 68 is adhered on surface 54, thereby providing good adhesion therebetween.

A second embodiment of the present invention will be described with reference to FIGS. 4 to 7.

Figure 4:
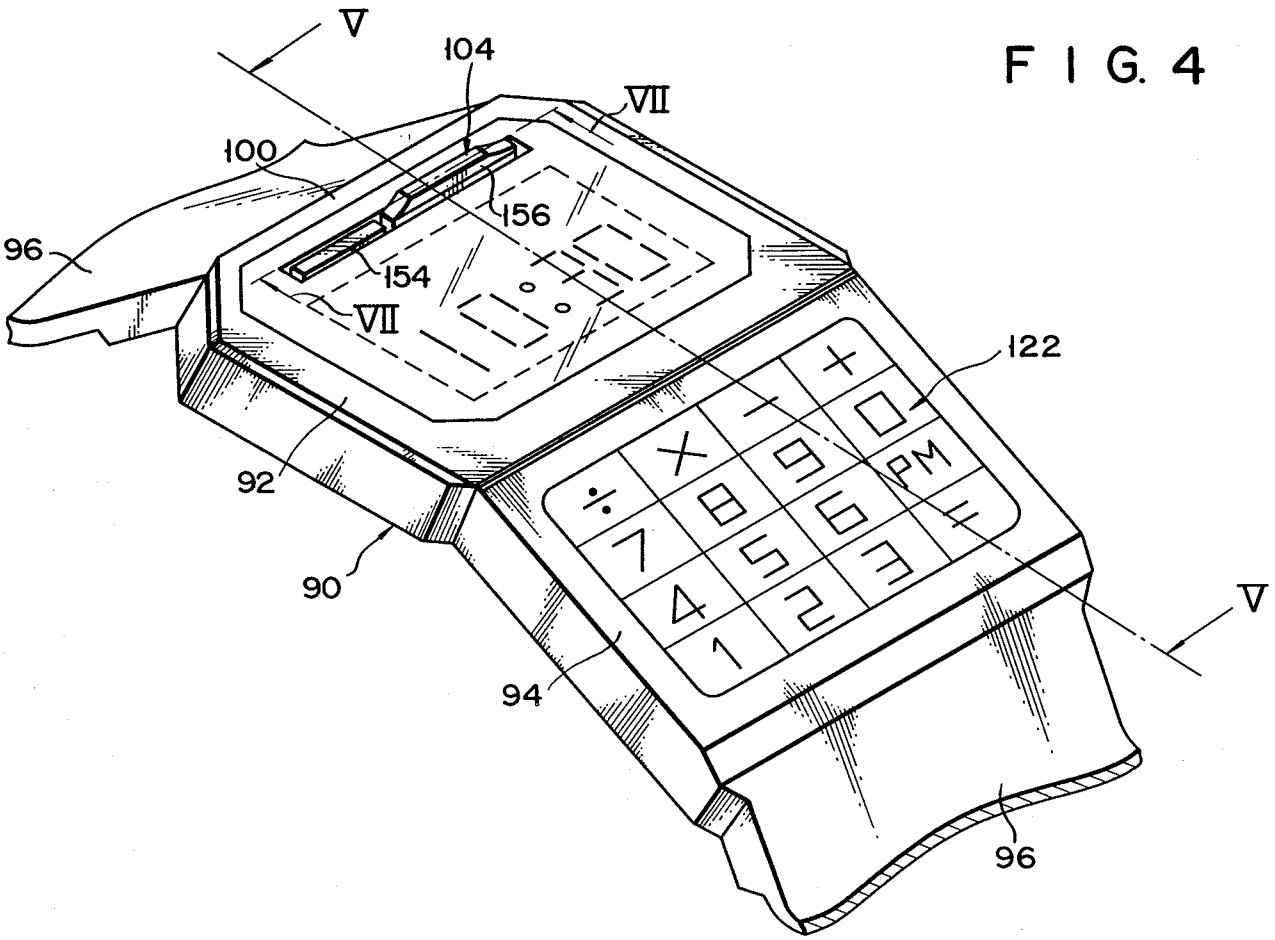
FIG. 4 is a perspective view of a battery-powered type wristwatch according to a second embodiment of the present invention.
Figure 5:
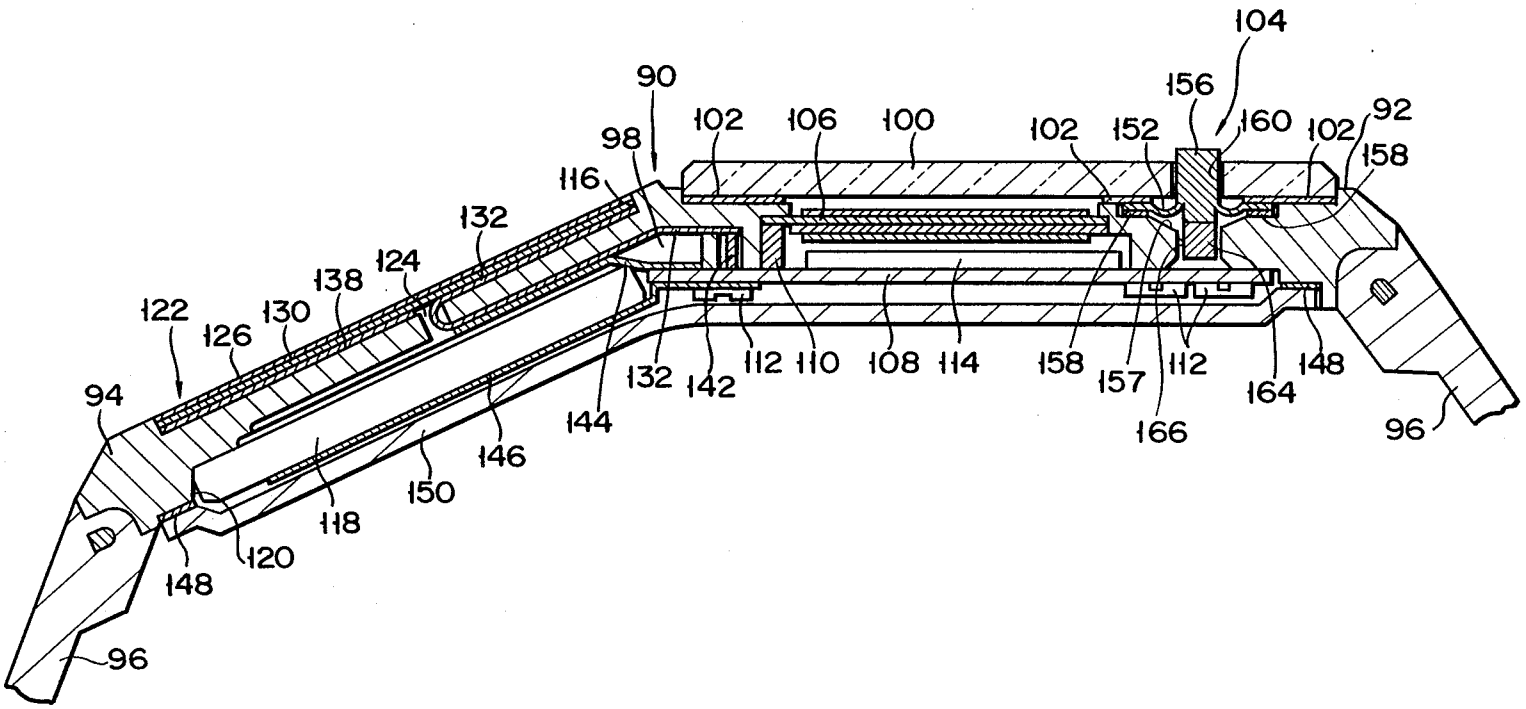
FIG. 5 is a sectional view of the wristwatch of FIG. 4 taken along the line V—V thereof.
Figure 6:
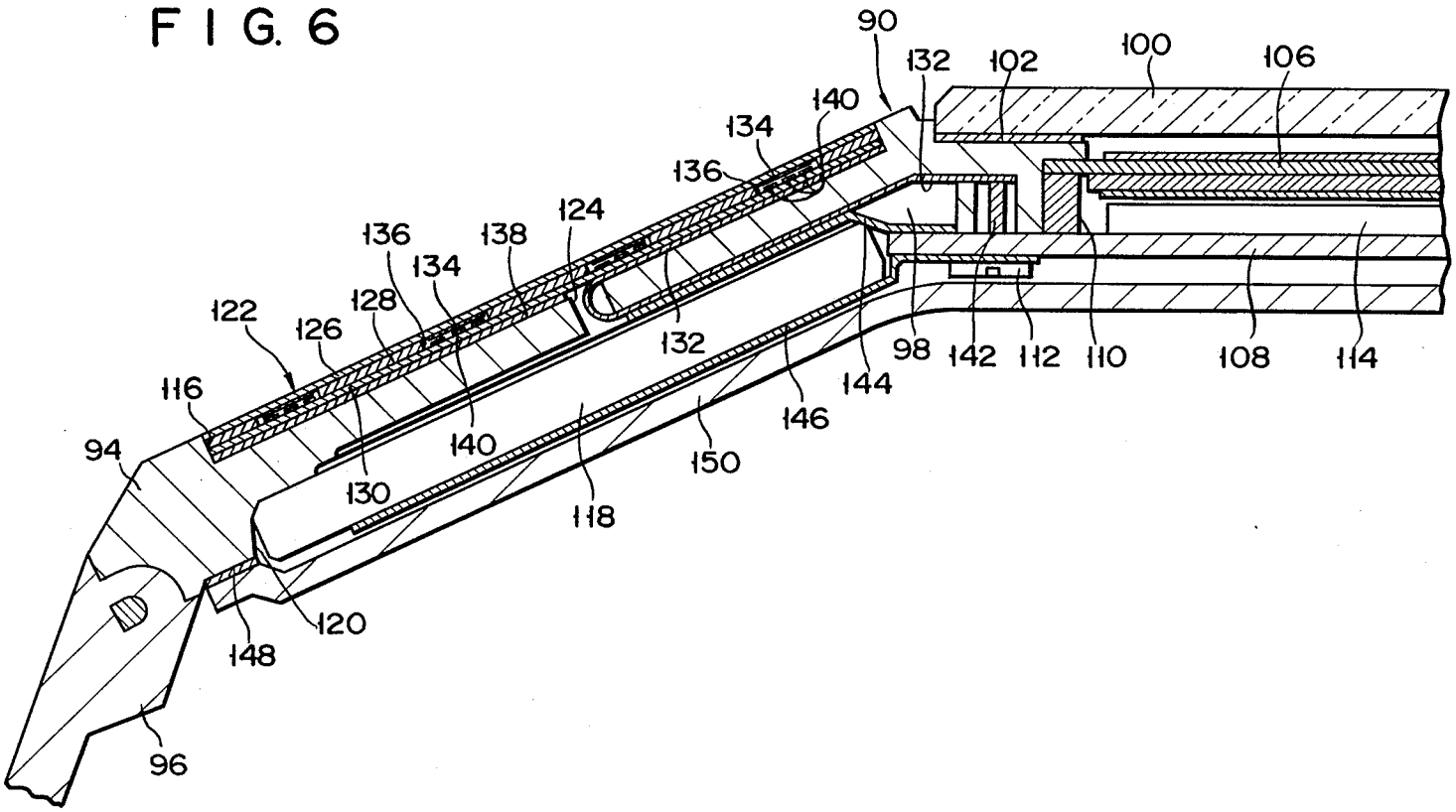
FIG. 6 is a partial enlarged view of the wristwatch of FIG. 5.
Figure 7:
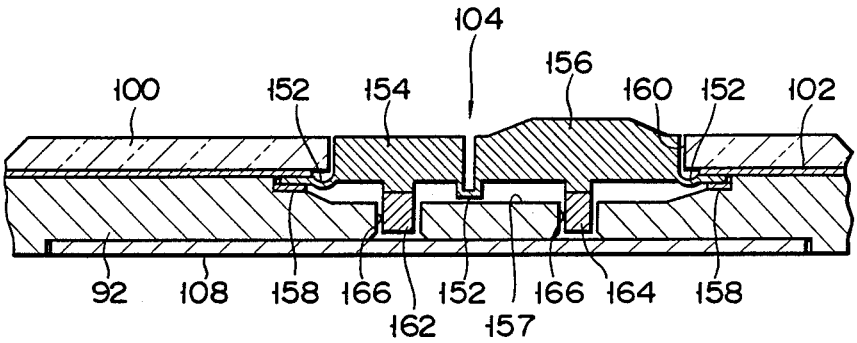
FIG. 7 is a sectional view of the wristwatch of FIG. 4 taken along the line VII—VII thereof.

FIG. 4 shows an outer appearance of a battery-powered type wristwatch with a calculator function, FIG. 5 shows a section thereof taken along the line of V—V of FIG. 4, FIG. 6 shows an enlarged main portion of the wristwatch, and FIG. 7 shows a section of the wristwatch taken along the line of VII—VII of FIG. 4. Wristwatch case 90 is formed integrally by injection molding. Case 90 has flat portion 92 and inclined portion 94 inclined downward by a predetermined angle (about 20 degrees). Flexible plastic watch bands 96 are integrally formed by injection molding with case 90 at corresponding ends of case 90. In this embodiment, the circuit means and the function data display means do not constitute a module, unlike in the first embodiment. As shown in FIG. 5, the circuit means and the function data display means are independently arranged in recess 98 of case 90, which extends from flat portion 92 to inclined portion 94. Therefore, the thickness of case 90 is smaller than that of case 10 of the first embodiment.

In FIG. 5, glass plate 100 is adhered by adhesive 102, such as a two-sided adhesive tape or the like, on flat portion 92 so as to cover an opening of recess 98 formed in flat portion 92. Pushbutton switch 104 extends through plate 100. Liquid crystal display device 106 and circuit board 108 serving as the circuit means for performing timepiece and calculator functions are arranged in a flat region of recess 98. Device 106 serves as a function data display means for displaying time and values calculated by the circuit means. Device 106 is located immediately under plate 100 and is electrically connected to board 108 through interconnector 110.

Board 108 is located under device 106 and fixed on the inner surface of recess 98 by screws 112 so as to press device 106 against the inner surface of recess 98 through interconnector 110. One end of board 108 extends in an inclined region of recess 98, and the other end extends below switch 104. LSI 114 is mounted on the upper surface of board 108.

Recess 116 is formed in the upper surface of inclined portion 94, as shown in FIGS. 5 and 6. Most of the inclined region of recess 98 constitutes battery housing 120 for storing button type battery 118. Recess 116 is formed in substantially the entire upper surface of inclined portion 94. The planar shape of recess 116 is square and relatively shallow. Key pad 122 as a circuit operation means is adhered in recess 116. Slit-like through hole 124 communicating with battery housing 120 is formed at the center of the bottom surface of recess 116.

As shown in FIG. 6, key pad 122 consists of printed sheet 126, spacer 128, and contact sheet 130, which are stacked downward in the order named. More specifically, flexible printed wiring board 132 is electrically connected to the lower surface of sheet 130. The uppermost printed sheet 126 is made of a flexible film. Key symbols (e.g., 1 to 0, +, −, ×, ÷) are printed on the film in the same manner as in the first embodiment. Movable contacts 134 are arranged on the lower surface of sheet 126 and respectively correspond to the key symbols. Spacer 128 is a sheet with openings 136 respectively corresponding to contacts 134. Contact sheet 130 is adhered to the lower surface of spacer 128, and in recess 116 of inclined portion 94 by adhesive 138. Stationary contacts 140 are formed on the upper surface of sheet 130 and respectively correspond to openings 136 of spacer 128. Contacts 140 are respectively separated from contacts 134 within openings 136 of spacer 128. More specifically, when the user depresses a desired key symbol of sheet 126, the corresponding movable contact 134 of sheet 126 is flexed downward and is brought into contact with corresponding stationary contact 140 through corresponding opening 136 of spacer 128.

Contacts 140 are electrically connected to terminals (not shown) formed on the lower surface of sheet 130. The terminals of sheet 130 are electrically connected to terminals (not shown) of flexible printed wiring board 132 adhered to the lower surface of sheet 130. Board 132 is inserted in hole 124 of recess 116 formed in inclined portion 94 of case 90 and is guided inside battery housing 120. Board 132 then extends to the flat region of recess 98 along the bottom surface of battery housing 120. An extended end of board 132 is located above board 108 and is electrically connected thereto through interconnector 142. The electrodes of battery 118 held inside battery housing 120 of inclined portion 94 are electrically connected to board 108 through first electrode plate 144 extending along the bottom surface of battery housing 120 and through second electrode plate 146 extending inside battery housing 120 so as to clamp battery 118 with first electrode plate 144.

The lower opening of recess 98 of case 90 extending from flat portion 92 to inclined portion 94 is covered by back cover 150 fixed on the lower surface of case 90 by fastening screws (not shown) through waterproof packing 148. Back cover 150 is a plate member and is bent in the same manner as the upper surfaces of flat and inclined portions 92 and 94 of case 90.

As shown in FIG. 4, switch 104 arranged in flat portion 92 has single elastic rubber sheet 152, time correction switch operation section 154 and mode selection switch operation section 156, which are all integrally formed of an identical material, as shown in FIGS. 5 and 7. Switch 104 is arranged in switch housing 157 formed in recess 98.

The edge of elastic rubber sheet 152 is adhered to the inner surfaces of plate 100 and switch housing 157 by adhesives 102 and 158 such as two-sided adhesive tapes so as to provide fixing and waterproof properties. Sections 154 and 156 are inserted in opening 160 formed in plate 100 and are exposed on the surface thereof. Section 154 is lower than section 156 so as to prevent depression errors. The upper surface of section 154 is substantially on the same plane as plate 100, and section 156 extends above the upper surface of plate 100 to allow easy operation thereof. Contact portions 162 and 164 of conductive rubber are integrally formed with the lower surfaces of sections 154 and 156. Contact portions 162 and 164 are vertically movable in through holes 166 formed in switch housing 157. The lower surfaces of portions 162 and 164 are separated from stationary contact portions (not shown) formed on board 108 within the flat region of recess 98. When sections 154 and 156 are depressed, sheet 152 is flexed to move contact portions 162 and 164 downward, and contact portions 162 and 164 are brought into contact with their corresponding stationary contact portions.

As described above, in the battery-powered type wristwatch of the second embodiment, electronic components such as device 106, board 108 and battery 118 are discretely arranged in recess 98, which extends in flat and inclined portions 92 and 94 of case 90. The electronic components thus do not constitute a module. Therefore, the thickness of the wristwatch of the second embodiment is smaller than that of the first embodiment. According to a sample product with the above arrangement, an overall thickness of this wristwatch was about 2 to 3 mm, and a wristwatch even more compact than that of the first embodiment was obtained.

Figure 8:
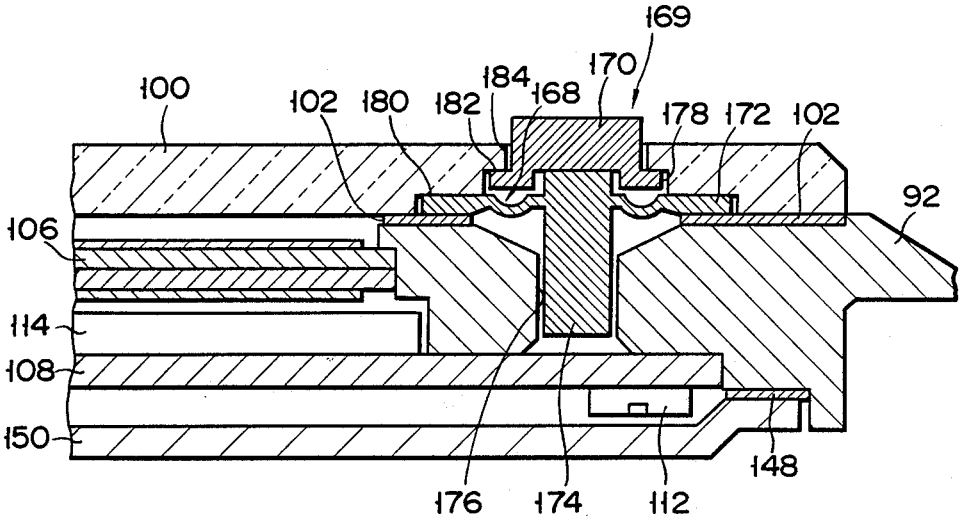
FIG. 8 is a partial enlarged sectional view showing a modification of a pushbutton switch according to the second embodiment.

FIG. 8 shows a modification of the second embodiment. In this modification, a recess for switch housing 168 is formed in the lower surface of plate 100. Switch 169 is arranged in switch housing 168. Switch 169 has a time correction switch operation section (not shown) and mode selection switch operation section 170 in the same manner as in the second embodiment. However, sheet 172 is integrally formed with contact portion 174 from conductive rubber, and switch operation section 170 is independent of sheet 172 and respective contact portions (only 174 is illustrated). Contact portion 174 is vertically movable in through hole 176, formed corresponding to switch housing 168 of plate 100. The lower end of contact portion 174 is separated from a corresponding stationary contact portion (not shown) formed on circuit board 108 within the flat region of recess 98. Section 170 is placed on the upper end of contact portion 174, and collar 178 is formed on the lower edge of section 170. Switch housing 168 is constituted by a multi-step recess. The edge of sheet 172 is placed on first step 180, where it is adhered by adhesive 102 such as a two-sided adhesive tape on the upper surface of flat portion 92 of case 90. Adhesive 102 also adheres plate 100 on the upper surface of flat portion 92 of case 90. Collar 178 of section 170 is located on second step 182. Section 170 is inserted in through hole 184 of step 182 and extends upward from the upper surface of plate 100. It should be noted that another time correction switch operation section and corresponding contact portions have the same arrangement as section 170 and contact portion 174. In the above modification, a low-profile wristwatch as in the second embodiment, and having a smaller thickness than that of the first embodiment can be obtained.

Figure 9:
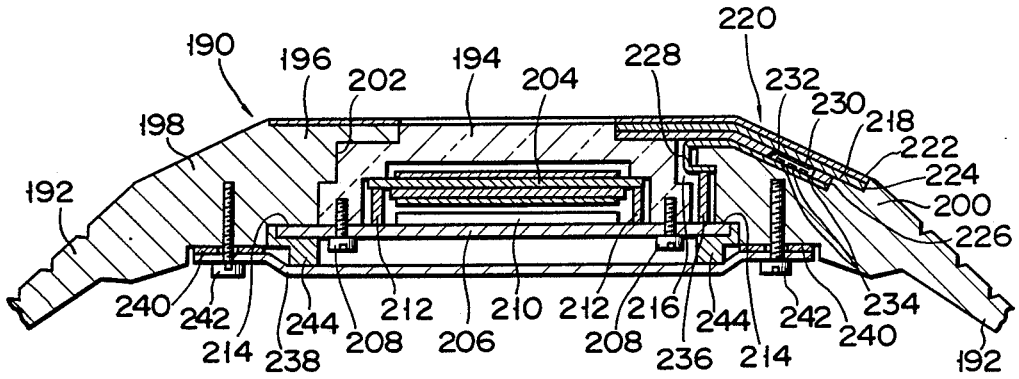
FIG. 9 is a sectional view of a battery-powered type wristwatch according to a third embodiment of the present invention.

A third embodiment of the present invention will be described with reference to FIG. 9.

In a wristwatch of the third embodiment, wristwatch case 190 and band 192 are integrally formed of soft plastic by injection molding. Glass plate 194 constitutes a housing so as to make a circuit means and a function information display means constitute a module. Case 190 consists of flat portion 196 and inclined portions 198 and 200, inclined downward from ends of flat portion 196 at a predetermined angle (about 20 degrees). The outer ends of inclined portions 198 and 200 have bands 192, respectively.

Plate 194 is located on the upper surface of a flat region of recess 202 formed in case 190 and is exposed on the surface thereof. Plate 194 has a lower opening and is recessed. Liquid crystal display device 204 is arranged in the recess. Circuit board 206 constituting the circuit means is fixed by screws 208 on the lower surface of plate 194. LSI 210 mounted on board 206 is also arranged in the recess in plate 194. Device 204 located above LSI 210 is electrically connected to board 206 through interconnectors 212, and is supported on the inner surface of the recess in plate 194.

Both ends of board 206 are supported by stepped portion 214 formed on the edge of the lower opening of the flat region thereof. Vertically extending space 216 is formed between one side of plate 194 and the inner surface of recess 202 which corresponds to that side of plate 194.

Recess 218 is formed extending from the upper surface of inclined portion 200 to the upper surface of flat portion 196. Key pad 220 is arranged in recess 218. Key pad 220 consists of printed sheet 222, upper contact sheet 224, spacer 226 and lower contact sheet 228, which are all stacked in the same manner as in the first embodiment. The uppermost printed sheet 222 is located in the entire recess 218 from inclined portion 200 side to flat portion 196 side. Various key symbols are printed on a sheet 222 portion corresponding to the inclined region in the same manner as in the first and second embodiments. An opening is formed in flat portion 196 corresponding to plate 194. The part of flat portion 196 excluding this opening serves as a decorative panel. It should be noted that a portion of printed sheet 222 corresponding to plate 194 may be transparent. Sheet 224 is adhered to the lower surface of sheet 222. Movable contacts 230 corresponding to the various key symbols of sheet 222 are formed on the lower surface of sheet 224. Sheet 224 extends from recess 218 to the edge of plate 194 of flat portion 196. Spacer 226 has openings 232 at positions corresponding to contacts 230 of sheet 224 and is adhered to the lower surface of sheet 224. Sheet 228 has stationary contacts 234 at positions corresponding to openings 232 of spacer 226. Only the inclined side portion of contact sheet 228 is adhered to the lower surface of spacer 226. The flat side portion of sheet 228 is inserted in space 216, and its front end is pressed against the inner surface of recess 202 by interconnector 236, electrically connected to board 206. Sheet 228 is thus electrically connected to board 206 through interconnector 236.

When the user depresses a desired key symbol of sheet 222, sheets 222 and 224 are flexed downward, and the corresponding movable contact 230 is brought into contact with the corresponding stationary contact 234 of sheet 228, so that a key signal is supplied to board 206 through interconnector 236.

Back cover 238 is fixed by screws 242 on the lower surface of case 190 through water seal member 240 so as to cover the lower opening of recess 202. Back cover 238 fixes board 206 on the inner surface of recess 202 of case 190 through module press ring 244.

In the battery-powered type wristwatch according to the third embodiment as described above, the electronic components such as device 204 and LSI 210 are arranged in the recess of plate 194, and plate 194 fixed on board 206 serves as a housing for causing the circuit means and the function data display means to constitute a module. As compared with a wristwatch with independent housings, the overall thickness of the wristwatch according to the third embodiment can be decreased. Furthermore, since plate 194 covers the electronic components as described above, case 190 can be made of soft plastic.

Figure 10:
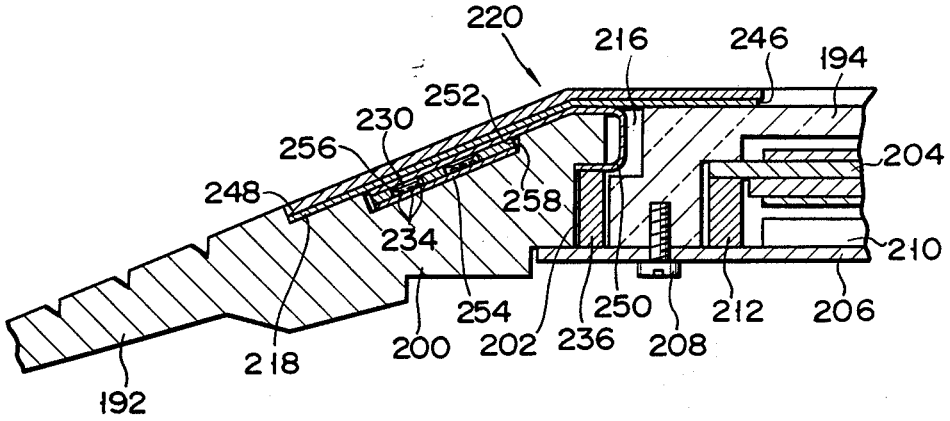
FIG. 10 is a partial enlarged sectional view of a modification of electrical connections in a key pad in the wristwatch of the third embodiment.

FIG. 10 shows a modification of the third embodiment. In this modification, key pad 220 consists of printed sheet 248 adhered by a two-sided adhesive tape to the bottom surface of recess 218 and the upper surface of plate 194, upper contact sheet 250, spacer 252 and lower contact sheet 254, all of which are stacked on each other. Sheet 248 is formed in the same manner as sheet 222 in the third embodiment. Sheet 250 has movable contacts 256 corresponding to the various key symbols of sheet 248 on the lower surface thereof. Recess 218 extends from the inclined portion 200 to the flat portion 196. A flat side end of sheet 250 is guided in through hole 216 formed between the inner surface of recess 202 and one side of glass plate 194. This flat side end is electrically connected to board 206 through interconnector 236 in hole 216. Spacer 252 and sheet 254 are located in another recess 258 formed in the bottom surface of recess 218 of inclined portion 200, and the arrangements thereof are the same as the third embodiment.

This modification has the same effect as that of the third embodiment.

In the embodiments described above, the key pad as the circuit operation switch means with the calculator function is arranged in the inclined portion of the wristwatch case. According to the principle of the present invention, a pushbutton switch shown in the second embodiment can be used in place of the key pad as the circuit operation switch means for calculator function.

FIGS. 11 to 15 show a modification of a key pad used in the first to third embodiments.

Figure 11:
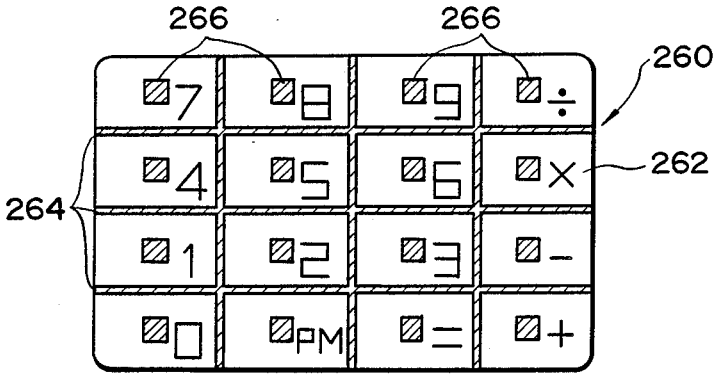
FIG. 11 is a plan view showing a modification of a key pad applied to the first to third embodiments of the present invention.
Figure 12:
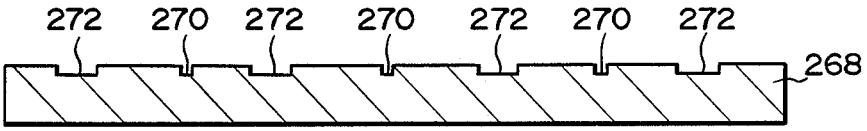
FIGS. 12 to 15 are sectional views for explaining the steps in manufacturing the key pad of FIG. 11.
Figure 13:
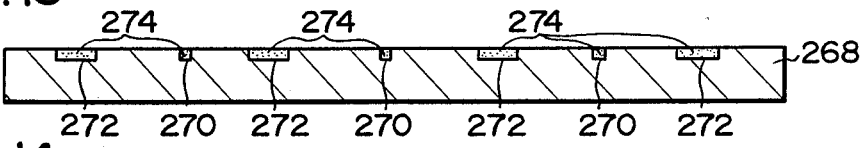
Figure 14:
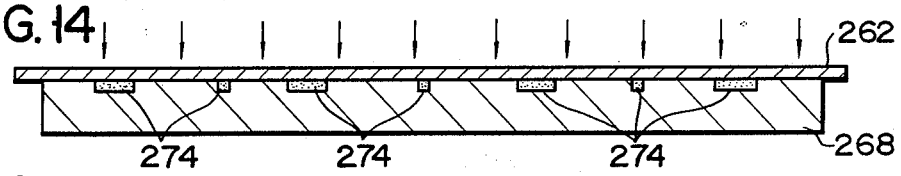
Figure 15:
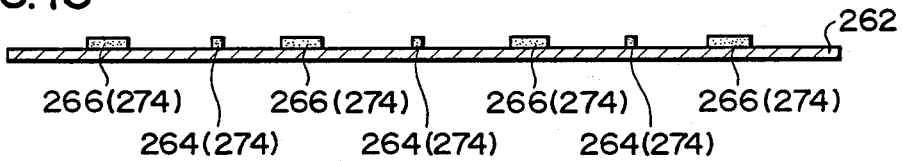

FIG. 11 is a plan view showing the modification of a key pad, and FIGS. 12 to 15 are sectional views for explaining the steps in manufacturing the key pad of FIG. 11. In key pad 260 in FIG. 11, partition projections 264 and key symbol projections 266 are formed by gravure printing on the surface of sheet 262. Projections 264 are formed to partition the various key symbols printed on sheet 262. Projections 266 are formed at central portions of the key symbol regions partitioned by projections 264. In order to form projections 264 and 266 on sheet 262, mold 268 shown in FIG. 12 is used. Mold 268 has partition recesses 270 corresponding to projections 264 and key symbol recesses 272 corresponding to projections 266. Mixture solution 274 of vinyl chloride and UV region (ultraviolet curing type resin) is filled in recesses 270 and 272. After recesses 270 and 272 are filled with solution 274, sheet 262 printed with the various key symbols is placed on the upper surface of mold 268, as shown in FIG. 14. Sheet 262 is irradiated with ultraviolet rays from above, and at the same time, heated to cure solution 274. Subsequently, sheet 262 is peeled from mold 268, and cured resin 274 on sheet 262 constitutes projections 270 and 272, as shown in FIG. 15.

In key pad 260 using sheet 262, when a finger tip is slid along the surface of sheet 262, the user can feel the proper key symbol positions. In particular, since projections 266 are formed at the central positions of the key symbol regions of the upper surface of sheet 262, key make (contact between the movable contacts formed on the lower surface of the key symbol corresponding regions of sheet 262 and the stationary contacts formed on the upper surface of lower contact sheet stacked on the lower surface of sheet 262 through the spacer) can be improved.

A fourth embodiment of the present invention will be described with reference to FIGS. 16 to 21.

Figure 16:
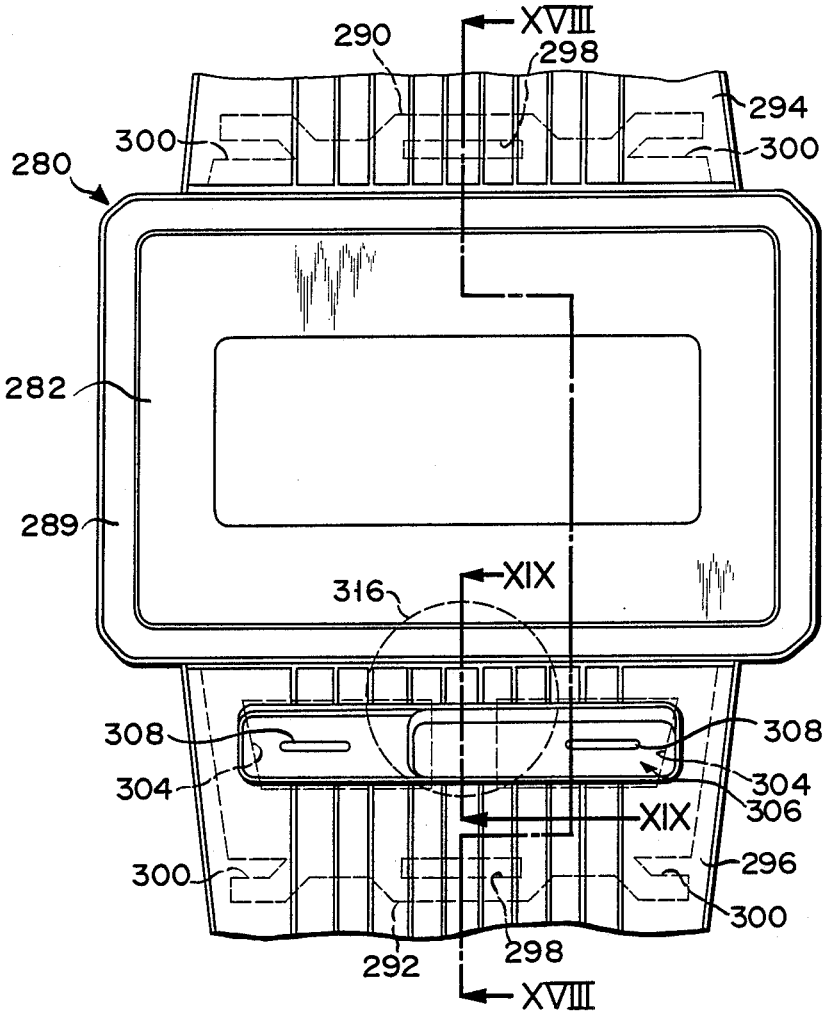
FIG. 16 is a plan view of a battery-powered type wristwatch according to a fourth embodiment of the present invention.
Figure 17:
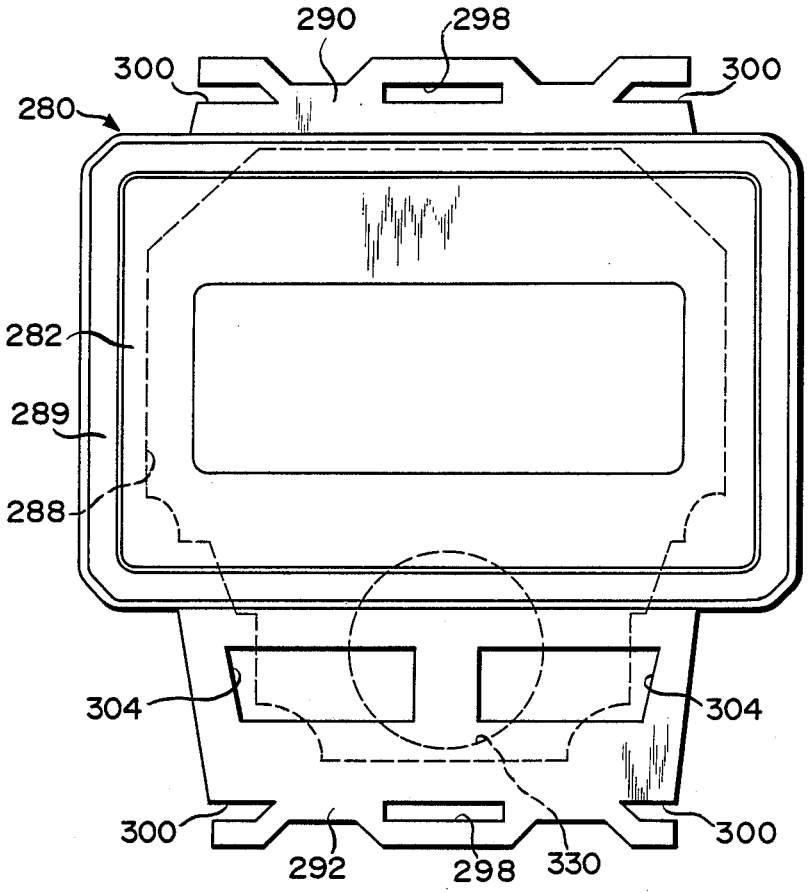
FIG. 17 is a plan view of a wristwatch case of the fourth embodiment.
Figure 18:
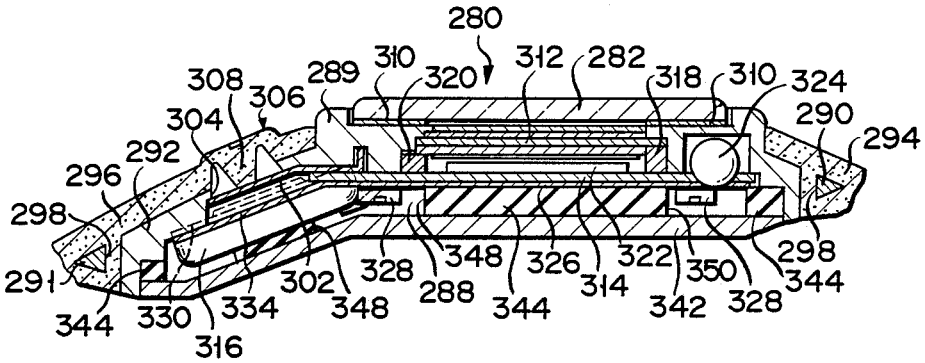
FIG. 18 is a sectional view of the wristwatch of FIG 16 taken along the line XVIII—XVIII thereof.

FIG. 16 is a front view of a battery-powered type wristwatch according to a fourth embodiment of the present invention. Wristwatch case 280 of this embodiment is formed of hard ABS resin by molding so as to provide a planar shape in FIG. 17. Glass plate 282 is fixed on the upper surface of case 280. Recess 288 for receiving various timepiece components is formed inside case 280, as shown in FIGS. 17 and 18. As shown in FIG. 17, case 280 has flat portion 289 on which plate 282 is fixed and inclined portion 292 inclined downward from flat portion 289 at a predetermined angle (about 20 degrees). The end of inclined portion 292 serve as band attaching portion 291, and the end of flat portion 289 serve as band attaching portion 290. Case 280 can best fit on a user's wrist.

Flexible wristwatch bands 294 and 296 are formed of soft plastic such as polyurethane resin by injection molding to be integral with case 280. This plastic is softer than that of case 280.

More specifically, the plastic of bands 294 and 296 is welded to band attaching portions 290 and 291 of case 280 to couple bands 294 and 296 to case 280. As shown in FIG. 17, each band attaching portion 290 or 291 has hole 298 and two notches 300. Therefore, bands 294 and 296 can be firmly welded to band attaching portions 290 and 291 of case 280.

Window holes 304 are formed in inclined portion 292 so as to locate contact 302 of, e.g., a leaf spring as shown in FIG. 18. During formation of bands 294 and 296, press operation portions 308 for circuit operation switch 306 are formed in band 296 (corresponding to inclined portion 292) at positions opposite holes 304. Press operation portions 308 have a spring property due to the elastic properties of the polyurethane resin constituting band 296.

Figure 19:
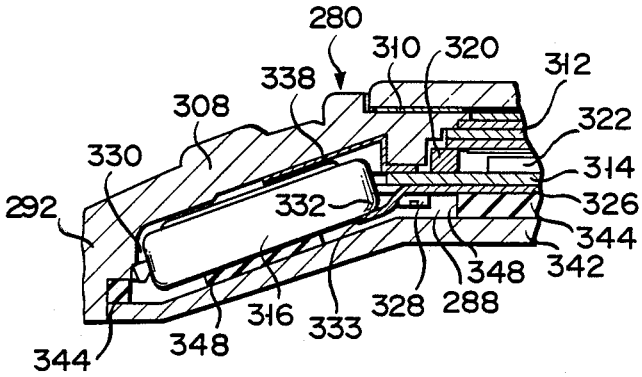
FIG. 19 is a partial sectional view of the wristwatch of FIG. 16 taken along the line of XIX—XIX thereof.
Figure 20:
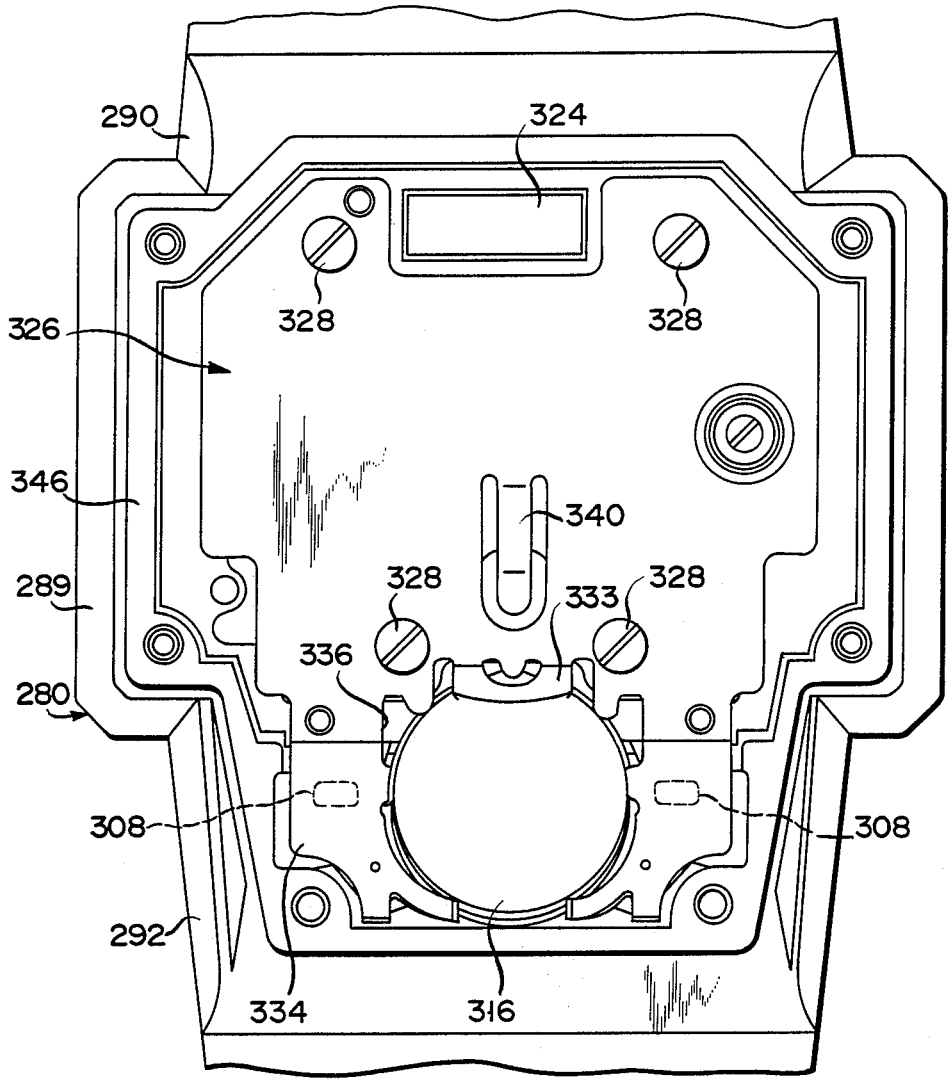
FIG. 20 is a bottom view of the wristwatch of FIG. 16 wherein a waterproof sheet and a lower cover are removed.

As shown in FIGS. 18 and 19, glass plate 282 is adhered by adhesive 310 such as a two-sided adhesive tape on the upper surface of flat portion 289 to cover an upper opening of recess 288. As shown in FIG. 18, liquid crystal display panel 312 as the circuit data display means, circuit board 314 as the circuit means, and battery 316 are independently arranged in recess 288. Panel 312 for displaying data such as time data calculated by the circuit means is elastically supported by board 314 on the inner surface of recess 288 through interconnector 318 and press member 320. As shown in FIG. 18, LSI 322 and quartz oscillator 324 are mounted on the upper surface of board 314 located below panel 312 within recess 288. Board 314 is supported by base plate 326 and is fixed on the inner surface of recess 288. Recess 288 at inclined portion 292 provided with switch 306 constitutes battery housing 330. Switch 306 is electrically connected to board 314 in recess 288 to cause the circuit means to perform time correction and mode selection. Battery housing 330 is inclined in the same manner as inclined portion 292, as shown in FIG. 19. Battery 316 held in battery housing 330 is inclined with respect to board 314, which in turn is located in the flat region of recess 288. Battery 316 in battery housing 330 is held by engaging tip 333 of base plate 326 extending into battery housing 330 to engage with edge 332 of lower surface of battery 316, as shown in FIG. 19. More specifically, inclined side portion 334 of base plate 326 fixed on the lower surface of board 314 extends obliquely downward along inclined portion 292, as shown in FIG. 18. Opening 336 is formed in inclined side portion 334 at a position corresponding to battery housing 330, as shown in FIG. 20. Engaging tip 333 is formed on an edge of opening 336 at the side of flat portion 289. The negative electrode of battery 316 held in battery housing 330 is electrically connected to board 314 via flexible printed wiring board 338 located on the upper surface of battery housing 330, as shown in FIG. 19. The positive electrode of battery 316 is electrically connected to board 314 via engaging tip 333 and terminal piece 340. Terminal piece 340 is formed at the center of plate 326, as shown in FIG. 20, and contacting an electrode terminal (not shown) of board 314.

Figure 21:
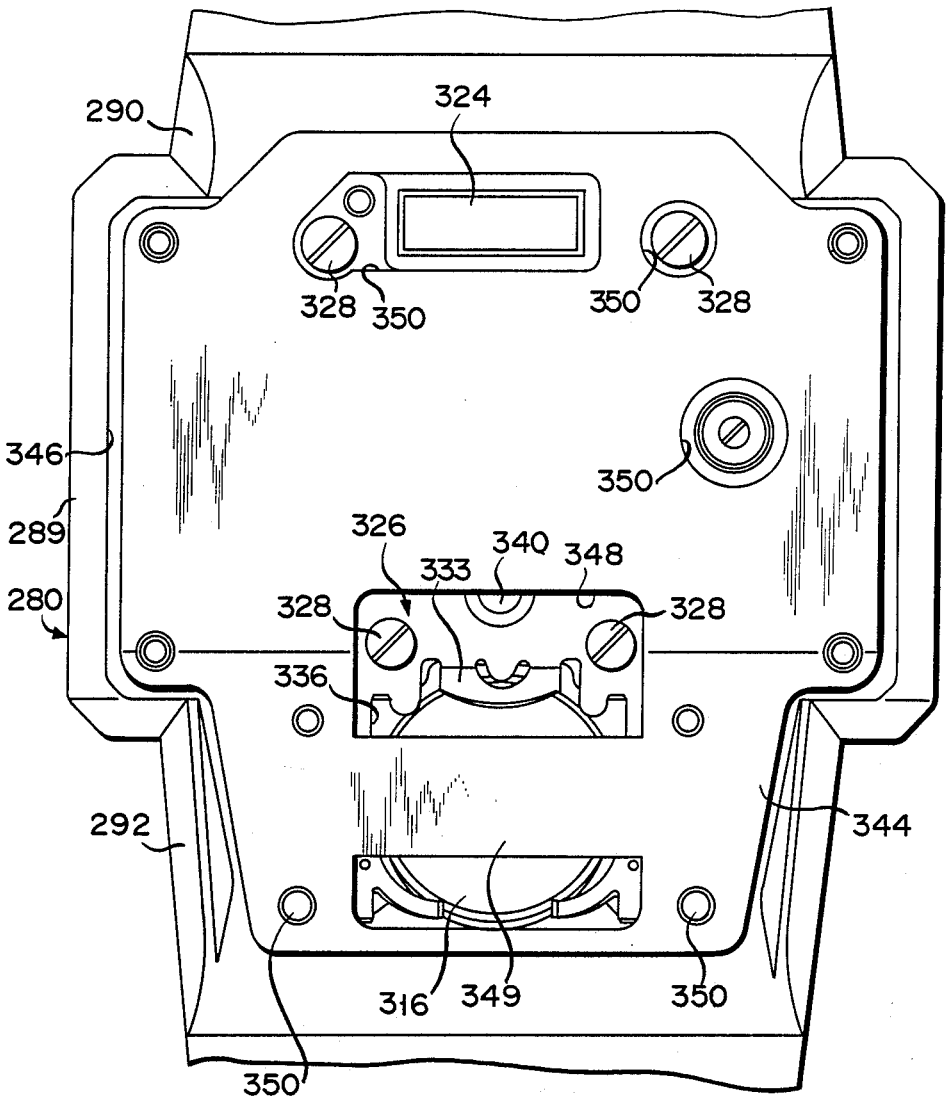
FIG. 21 is a bottom view of the wristwatch of FIG. 16 wherein the lower cover is removed.

As shown in FIGS. 18 and 19, the lower opening of recess 288 of case 280 is covered by back cover 342 extending from flat portion 289 to inclined portion 292 with battery housing 330. Back cover 342 is mounted on the lower surface of case 280 through waterproof rubber 344. A portion of rubber 344 which corresponds to flat portion 289 is flat, and a portion thereof corresponding to inclined portion 292 is inclined. Rubber 344 provides a waterproof property to recess 288 and support battery 316 in battery housing 330. The edge of rubber 344 is located in step 346 formed on the edge of the lower opening of recess 288 of case 280, as shown in FIG. 20. Opening 348 is formed in a portion of waterproof rubber 344 corresponding to battery housing 330, as shown in FIG. 21. Press portion 349 forms a bridge at the intermediate portion of opening 348 so as to press the lower surface of battery 316, as shown in FIGS. 18 and 19. Holes 350 are formed at waterproof rubber 344 positions corresponding to oscillator 324 and screws.

In the battery-powered type wristwatch according to the fourth embodiment, bands 294 and 296 are inclined at the predetermined angle with respect to flat portion 289 of case 280, and battery housing 330 formed in inclined portion 292 is inclined with respect to board 314 arranged in the flat region of recess 288. Therefore, battery 316 is slid along inclined portion 292 to bring edge 332 of lower surface of battery 316 engage with engaging tip 333 of base plate 326 extending inside battery housing 330 to hold battery 316 therein. Battery 316 can thus be easily mounted in or removed from battery housing 330.

Furthermore, since battery 316 is pressed by back cover 342 through press portion 349 of rubber 344 from below, it is firmly fixed inside battery battery housing 330.

In the battery-powered type wristwatch having the arrangement described above, board 314 with oscillator 324, LSI 322, and panel 312 are arranged in the flat region of recess 288, and battery housing 330 is formed in inclined portion 292 inclined with respect to flat portion 289, thereby providing low-profile case 280. In case 280 of a sample product from the present inventors, an inclination angle of inclined portion 292 with respect to flat portion 289 is about 20 degrees, and an overall length of flat portion 289 is about 19 to 20 mm, thus providing a compact structure.

In the battery-powered type wristwatch described above, switch 306 is arranged in inclined portion 292 inclined with respect to flat portion 289. Thus, even if the user's wrist is inclined to read data displayed on panel 312, switch 306 can be easily operated.

In the above embodiment, a button type battery is used. However, a solar cell may be formed on the surface of case 280, and a capacitor for charging by a solar cell may be arranged in battery housing 330.

The present invention is not limited to a battery-powered type wristwatch, but can also be applied to compact electronic equipment such as a compact electronic calculator fitted on a part of surface of a user's body such as a wrist, an ankle or an upper arm, or as a pendant type watch.

A battery-powered type wristwatch according to a fifth embodiment of the present invention will be described with reference to FIGS. 22 to 28.

Figure 22:
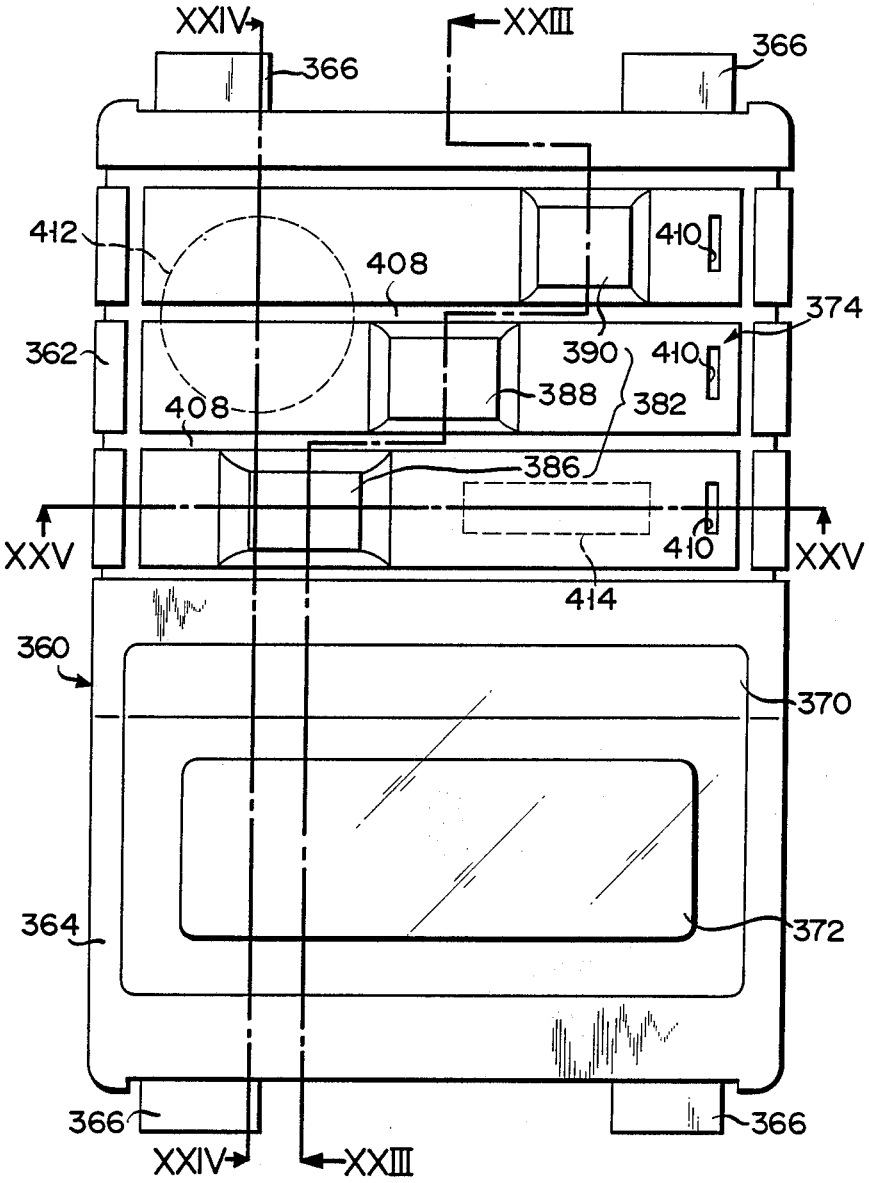
FIG. 22 is a plan view of a battery-powered type wristwatch according to a fifth embodiment of the present invention.
Figure 23:
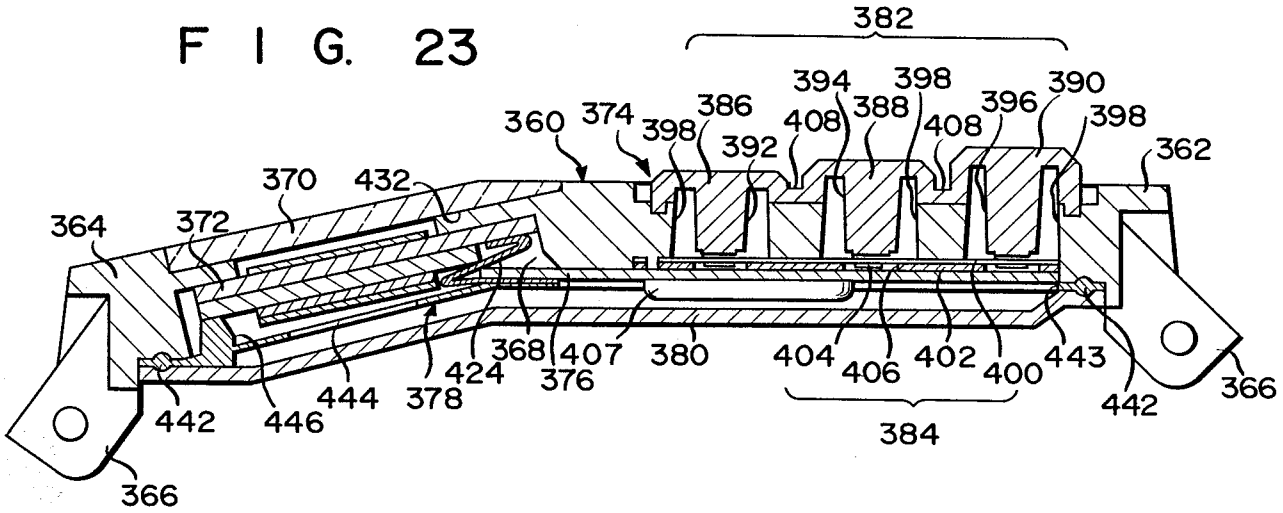
FIG. 23 is a sectional view of the wristwatch of FIG. 22 taken along the line XXIII—XXIII thereof.

FIG. 22 is an enlarged plan view of the battery-powered type wristwatch according to the fifth embodiment of the present invention, and FIG. 23 is a sectional view thereof taken along the line XXIII—XXIII of FIG. 22. Wristwatch case 360 is made of plastic by injection molding and has flat portion 362 and inclined portion 364 inclined at a predetermined angle (about 12 to 14 degrees) with respect to flat portion 362. Band attaching portions 366 for watch bands (not shown) are coupled to outer ends of case 360. Glass plate 370 is adhered by an adhesive such as a two-sided adhesive tape on the upper surface of inclined portion 364 to cover an upper opening of the inclined region of recess 368. Liquid crystal display device 372 is arranged immediately below plate 370 in the inclined region of recess 368 to display data such as time data. Circuit operation switch 374 is arranged on the upper surface of flat portion 362. Circuit board 376 is arranged in the flat region of recess 368. The lower opening of recess 368 extending from inclined portion 364 to flat portion 362 is covered by back cover 380 fixed on the lower surface of case 360 through waterproof sheet 378. In this embodiment, sheet 378 waterproofs recess 368 and elastically supports device 372 on the inner surface of recess 368. Back cover 380 is bent in the same manner as the upper surface of case 360.

Circuit operation switch 374 for causing the wristwatch of the fifth embodiment to perform time correction, mode selection and stopwatch functions has operation button section 382 extending upward from the upper surface of flat portion 362 and contact sheet 384 located in the flat region of recess 368 so as to correspond to the inner end of section 382, as shown in FIG. 23. Section 382 is made of an elastic rubber sheet and has a plurality of operation projections (three in this embodiment, namely, 386, 388 and 390). Contacts 392, 394 and 396 are formed on this sheet at positions corresponding to projections 386, 388 and 390.

As shown in FIG. 22, projections 386, 388 and 390 are arranged in a direction from the lower left end to the upper right end (substantially on a diagonal line) of flat portion 362, as shown in FIG. 22. Left projection 386 has the lowest height among the projections. Central projection 388 is higher than projection 386, and right projection 390 is the highest. The heights of the projections are determined in accordance with the frequency of use thereof. In this embodiment, lowest projection 386 is used least and serves as a time correction projection. Projection 388 serves as a mode selection projection. Highest right projection 390 is most frequently used and serves as a stopwatch projection. Projections 386, 388 and 390 can be depressed and elastically deformed to move contacts 392, 394 and 396 downward, respectively. Contacts 392, 394 and 396 are arranged in through holes 398 extending from the upper surface of flat portion 362 to the flat region of recess 268. The lower end faces of contacts 392, 394 and 396 come close to or contact the upper surface of contact sheet 384 located in the flat region of recess 268.

Sheet 384 consists of film sheet 400 and insulating sheet 402 adhered by a two-sided adhesive tape or the like on the lower surface of sheet 400. Sheet 400 is a flexible transparent sheet. Movable contacts 404 are formed by a known technique such as printing on the lower surface of film sheet 400 so as to correspond to contacts 392, 394 and 396. Sheet 402 is placed on the upper surface of circuit board 376 and serves as a spacer between board 376 and sheet 400. Sheet 402 has openings 406 at positions respectively corresponding to movable contacts 404. Contacts 404 located within openings 406 respectively oppose stationary contacts (not shown) on board 376. When sheet 400 is moved downward by contacts 392, 394 and 396, movable contacts 404 are brought into contact with corresponding stationary contacts (not shown) on board 376. Reference numeral 407 denotes an LSI fixed on the lower surface of board 376. Grooves 408 extending in the lateral direction at boundaries of projections 386, 388 and 390 are formed on the upper surface of an elastic sheet constituting section 382, as shown in FIG. 22. Recesses 410 are formed at one side (right side) of three laterally elongated regions partitioned by grooves 408. Different color materials (e.g., paints or colored members) are embedded in grooves 408 or recesses 410 so as to identify the different functions of projections 386, 388 and 390.

Figure 24:
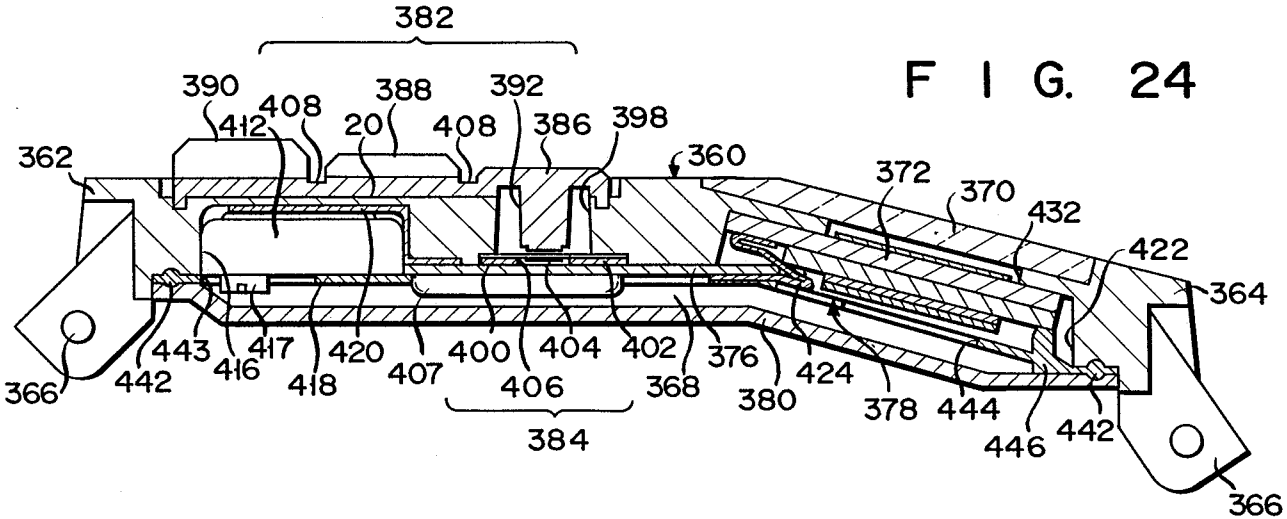
FIG. 24 is a sectional view of the wristwatch of FIG. 22 taken along the line XXIV—XXIV thereof.
Figure 25:
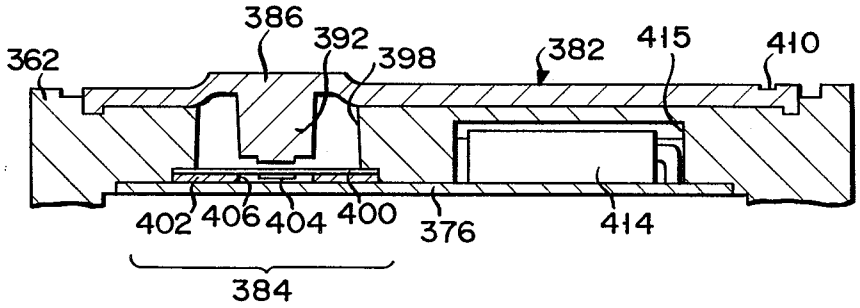
FIG. 25 is a sectional view of the wristwatch of FIG. 22 taken along the line XXV—XXV thereof.

As shown in FIGS. 24 and 25, battery 412, quartz oscillator 414 and a capacitor (not shown) are arranged on the upper surface of board 376 in the flat region of recess 368 so as to offset from contacts 392, 394 and 396 of section 382. Oscillator 414 is housed in quartz housing 415 formed in the flat region of recess 368. Battery 412 is housed in battery housing 416 formed in the flat region of recess 368. The lower surface of battery 412 is supported by battery press plate 418 fixed by screw 417 to board 376. Battery press plate 418 causes one electrode of battery 412 to be electrically connected to board 376. The other electrode of battery 412 is electrically connected to board 376 by terminal 420 arranged along the bottom surface of battery housing 416.

One end of board 376 extends inside liquid crystal display device housing 422 formed in the inclined region of recess 368. The extended portion is electrically connected to liquid crystal display device 372 through flexible printed wiring board 424, as shown in FIGS. 24 and 25.

Figure 26:
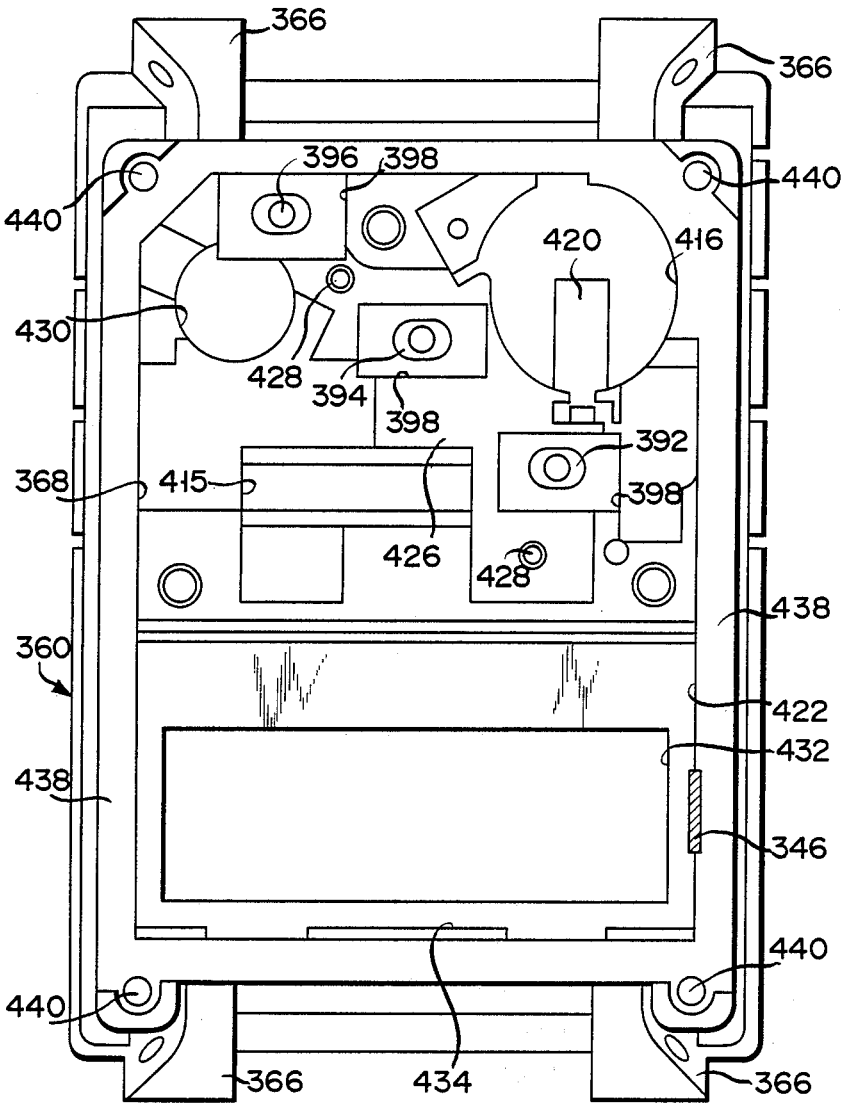
FIG. 26 is a bottom view of a waterproof sheet.
Figure 27:
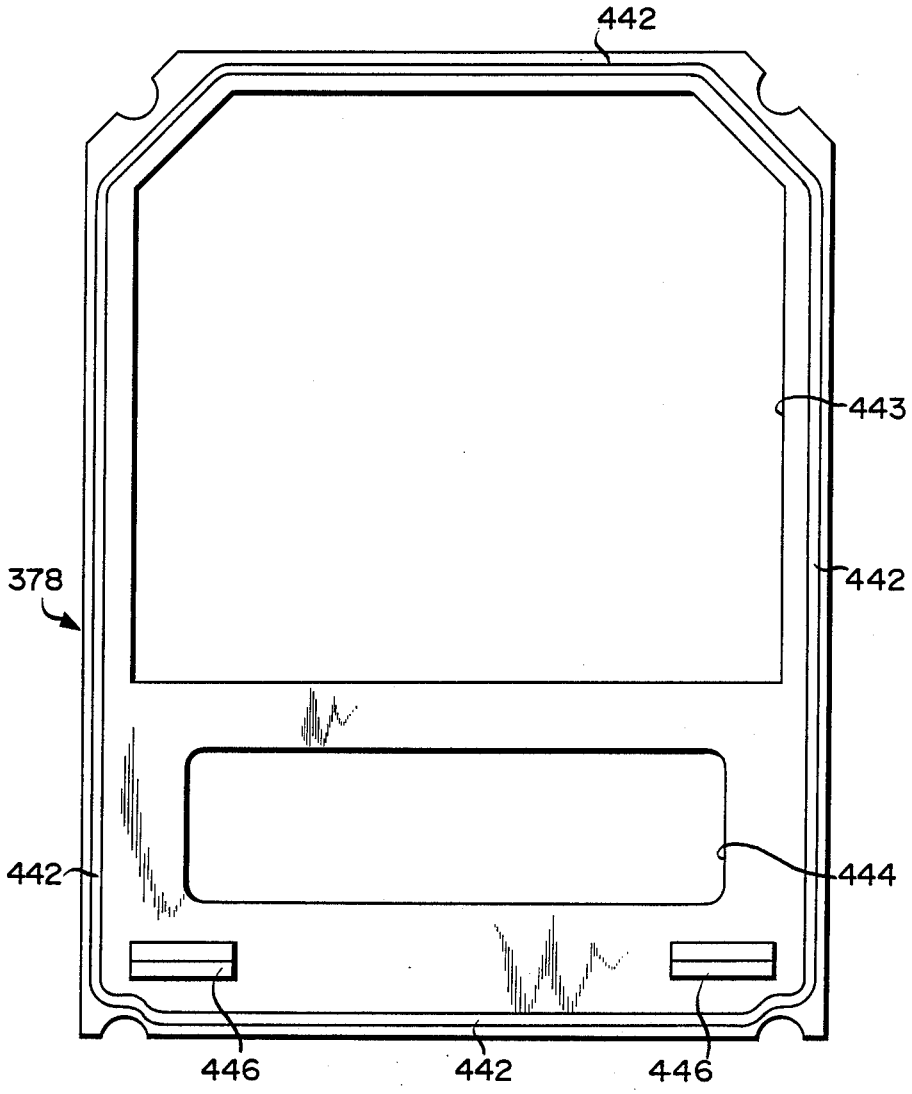
FIG. 27 is a bottom view of a wristwatch case wherein a waterproof sheet and a lower cover are removed.

FIG. 26 is a bottom view of case 360. Contact housing 426 for contact sheet 384 is formed on the buttom surface of the flat region of recess 368 along through holes 398 for contacts 392, 394 and 396 of section 382. Positioning projections 428 of sheet 384 are formed at predetermined positions of contact housing 426. Battery housing 416, capacitor housing 430, and quartz housing 415 are formed on the bottom surface of the flat region of recess 368 at the upper right corner, the upper left corner, and lower left corner thereof so as to interpose contact housing 426 therebetween. Liquid crystal display device housing 422 is formed on the bottom surface of the inclined region of recess 368. Opening 432 is formed on the bottom surface of liquid crystal display device housing 422 so that the user can read data such as time data displayed on device 372 from the upper surface of case 360 through glass plate 370. Abutment positioning portion 434 for abutting the side surface of device 372, and elastic member 346 for elastically urging the side surface of device 372 are formed on the inner wall surfaces of liquid crystal display device housing 422. Step 438 abutting against the edge of waterproof sheet 378 of a planar shape in FIG. 27 is formed on the edge of recess 368. Screw holes 440 threadably engaged with screws are formed to fix back cover 380 at its four corners.

Sheet 378 for waterproofing recess 368 and supporting device 372 is made of soft resin such as rubber, as shown in FIGS. 23, 24 and 27. Waterproof portion 442 of a circular sectional shape is formed at the entire edge of sheet 378. Sheet 378 has openings 443 and 444 at positions corresponding to board 376 and device 372, respectively arranged in the flat and inclined regions of recess 368. Support projections 446 are formed near opening 444. Projections 446 elastically support one side of the lower surface of device 372 (FIGS. 23 and 24) on the bottom surface of recess 368 from below. The other side of the lower surface of device 372 is supported on the bottom surface of recess 368 via flexible printed wiring board 424 for electrically connecting device 372 to board 376, as shown in FIGS. 23 and 24. More specifically, a folded portion of wiring board 424 between the lower surface of device 372 and the upper surface of board 376 elastically support device 372 on the bottom surface of recess 368. Device 372 is also elastically held on the inner surface of housing 422 by elastic member 346 (FIG. 26) arranged on the inner surface of liquid crystal display device housing 422.

In the battery-operated type wristwatch of the fifth embodiment described above, since projections 446 of sheet 376 of soft plastic such as rubber elastically support and press device 372 on the inner surface of recess 368, device 372 can be properly fixed on the inner surface of recess 368, thereby allowing easy arrangement of the fixing means and simplifying a fixing operation. Furthermore, since device 372 is arranged in inclined portion 364 inclined at a predetermined angle with respect to flat portion 362, device 372 is inclined when the user wears the wristwatch on his wrist or places it on a desk. Data displayed on device 372 can therefore be easily read. Electronic components such as device 372 and board 376 are discretely arranged in flat portion 362 and inclined portion 364, thereby decreasing the thickness of case 360. In case 360 of a sample wristwatch by the present inventors, an inclined angle of inclined portion 364 with respect to flat portion 362 is about 12 to 14 degrees, an overall length of inclined portion 364 is about 14 to 15 mm, an overall length of flat portion 362 is about 22 to 23 mm, and an overall thickness of case 360 is about 4 mm, thereby providing a very low-profile wristwatch.

Figure 28:
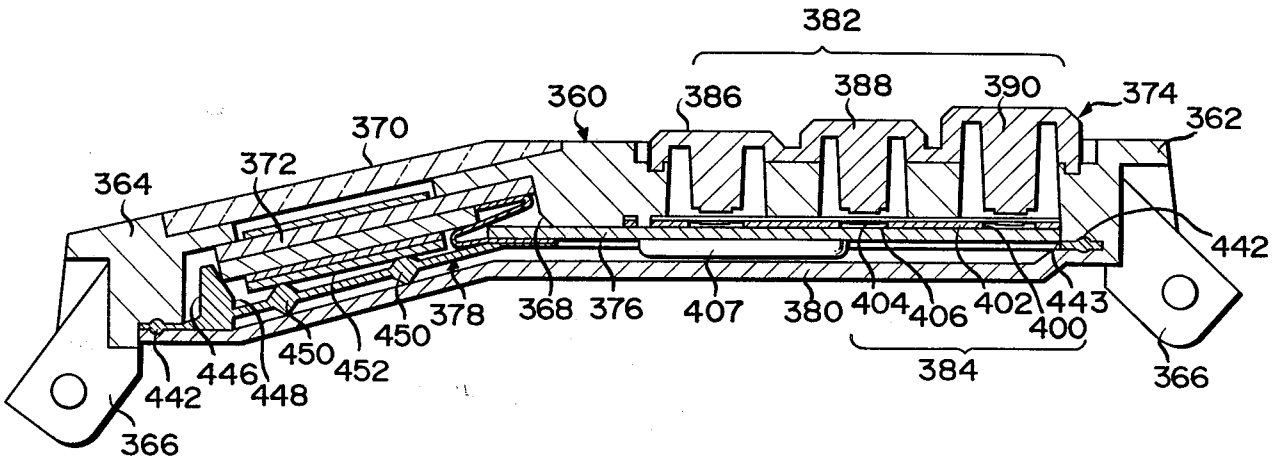
FIG. 28 is a sectional view showing a modification of a waterproof sheet.

FIG. 28 shows a modification of a waterproof sheet. In waterproof sheet 378 of this modification, inclined surface 448 is formed on the upper portion of projection 446. One side of the lower surface of device 372 is elastically supported. Since surface 448 urges one side of device 372 upward, the upper surface of device 372 can abut against the bottom surface of recess 368, and the side surface thereof at the flat region side can abut against the inner surface of recess 368. Therefore, device 372 can be even better supported than in the fifth embodiment.

As shown in FIG. 28, press portions 450 may be formed in opening 444 of water protective sheet 378 in addition to slanted surface 448 of the upper portion of projection 446 so as to elastically support the lower edge of device 372. Sheet 378 with press portions 450 more effectively supports device 372 on the inner surface of recess 368, as compared with the waterproof sheet of the fifth embodiment shown in FIG. 27. In addition, reflecting plate 452 may be supported on the lower surface of device 372.

The above embodiments exemplify battery-powered type wristwatches. However, the present invention is not limited to this. The present invention can also be applied to other compact electronic equipment such as clocks, electronic portable calculators, pedometers for counting number of footsteps in walking, pacemakers for generating sounds for signalling jogging paces, stopwatches, and electronic game equipment.

What is claimed is:

1. Battery powered type compact electronic equipment comprising:

circuit means for performing various functions, said circuit means including a circuit board on which an electronic circuit is formed;

function data display means for displaying function data executed by said circuit means;

a case integrally formed from a synthetic resin and provided with a flat portion and an inclined portion inclined at a predetermined angle with respect to said flat portion, said case having a bent storage space formed by connecting a flat storage space formed in the flat portion with an inclined storage space formed in the inclined portion so as to define a substantially-single bent space, the bent storage space containing said circuit means and said function data display means therein so that the circuit board extends from the flat storage space straight into the bent storage space; and means for electrically connecting in the bent storage space the electronic circuit formed on said part of the circuit board with at least one element of the circuit means arranged in the bent storage space.

2. Equipment according to claim 1, wherein said case has a recess for storing said circuit means and said function data display means, said recess is covered with a cover separated from said case, and a sealing member is arranged in said recess and is pressed by said cover, said sealing member being made of an elastic material and being pressed by said cover to elastically hold at least said function data display means in said recess.

3. Equipment according to claim 1, wherein said function data display means is held in one of said flat and inclined portions of said case, and said circuit means includes at least one component held in the other of said flat and inclined portions of said case.

4. Equipment according to claim 3, wherein said at least one component held in the other of said flat and inclined portions is a battery for supplying power to said circuit means.

5. Equipment according to claim 3, wherein said at least one component of said circuit means, held in the other of said flat and inclined portions, is circuit operation switch means for controlling operation of said circuit means.

6. Equipment according to claim 5, wherein said circuit operation switch means is at least one pushbutton switch.

7. Equipment according to claim 5, wherein said circuit operation switch means is a key pad with at least one switch.

8. Equipment according to claim 3, wherein said at least one component of said circuit means, held in the other of said flat and inclined portions, comprises circuit operation switch means for controlling operation of said circuit means and a battery for supplying power to said circuit means.

9. Equipment according to claim 8, wherein said circuit operation switch means is at least one pushbutton switch.

10. Equipment according to claim 9, wherein said pushbutton switch includes an operation portion integrally formed from an elastic synthetic resin with said case.

11. Equipment according to claim 9, wherein said circuit operation switch means is a plurality of pushbutton switches, said plurality of pushbutton switches being provided with a plurality of operation portions extending upward from an outer surface of said case such that heights of said plurality of operation portions are different from each other.

12. Equipment according to claim 8, wherein said circuit operation switch means is at least one pushbutton switch arranged in said other of said flat and inclined portions of said case so as not to overlap said battery.

13. Equipment according to claim 8, wherein said circuit means includes a circuit board arranged in said one of said flat and inclined portions of said case, and said battery arranged in said other of said flat and inclined portions of said case is inclined with respect to said circuit board.

14. Equipment according to claim 8, wherein said circuit operation switch means comprises a plurality of switches obliquely arranged on an outer surface of said other of said flat and inclined portions of said case.

15. Equipment according to claim 8, wherein said circuit operation switch means is a key pad with at least one switch.

16. Battery powered type compact electronic equipment comprising:

circuit means for performing various functions, said circuit means including a circuit board on which an electronic circuit is formed;

function data display means for displaying function data executed by said circuit means;

a case integrally formed from a synthetic resin and provided with a flat portion and an inclined portion inclined at a predetermined angle with respect to said flat portion, said case having a bent storage space formed by connecting a flat storage space formed in the flat portion with an inclined storage space formed in the inclined portion so as to define a substantially-single bent space, the bent storage space containing said circuit means and said function data display means therein so that the circuit board extends from the flat storage space straight into the bent storage space; and means for electrically connecting in the bent storage space the electronic circuit formed on said part of the circuit board with at least one element of the circuit means arranged in the bent storage space; and band means integrally formed with said case, said band means being adapted to cause said case to fit flush with a part of the surface of a user's body.

17. Equipment according to claim 16, wherein said case has a recess for storing said circuit means and said function data display means, said recess being covered with a cover separated from said case, and a sealing member is arranged in said recess and is pressed by said cover, said sealing member being made of an elastic material and being pressed by said cover to elastically hold at least function data display means in said recess.

18. Equipment according to claim 16, wherein said function data display means is held in one of said flat and inclined portions of said case, and said circuit means includes at least one component held in the other of said flat and inclined portions of said case.

19. Equipment according to claim 18, wherein said at least one component held in the other of said flat and inclined portions is a battery for supplying power to said circuit means and circuit operation switch means for controlling operation of said circuit means.

20. Equipment according to claim 19, wherein said circuit operation switch means is at least one pushbutton switch arranged in said other of said flat and inclined portions of said case so as not to overlap said battery.

21. Equipment according to claim 18, wherein said case has a recess for storing said circuit means and said function data display means, and said band means has a recess comprising part of said recess in cooperation with said other of said flat and inclined portions of said case.

22. Equipment according to claim 21, wherein said at least one component of said circuit means arranged in said other of said flat and inclined portions of said case includes circuit operation switch means for controlling operation of said circuit means, said circuit operation switch means being provided with operation portions integrally formed from an elastic synthetic resin with said band means.

23. Equipment according to claim 1, wherein said circuit means has at least a time signal generating function, and said equipment is a timepiece.

24. Equipment according to claim 16, wherein said circuit means has at least a time signal generating function, and said equipment is a timepiece.

25. A compact wrist watch capable of performing calculations, said watch comprising:

circuit means including a circuit board on which an electronic circuit is formed, for measuring time, performing calculations on input data, and outputting results of the calculations;

data display means for displaying time data and the calculation results output from said circuit means;

a case made of a synthetic resin and formed integrally with a flat portion and an inclined portion inclined at a predetermined angle with respect to said flat portion, said case having a bent single storage space consisting of a flat storage space section formed in said flat portion, and an inclined storage space section formed in said inclined portion and being continuous and substantially uninterrupted with said flat storage space section, said flat storage space section containing said circuit means and said data display means, such that said circuit board extends from the flat storage space section into the inclined storage spage section;

data input switch means mounted on that surface of said inclined portion which faces outwardly and in the opposite direction to a surface facing inwardly and which defines one wall of the inclined storage space section, for inputting data to said circuit means;

a battery set in said bent storage space section and being to said data input switch means, for supplying power to said circuit means; and means for electrically connecting said electronic circuit on said circuit board in said inclined storage space section to said battery and also to said switch means.

26. The compact wrist watch according to claim 25, wherein said data input switch means is a key pad with at least one switch.

27. The compact wrist watch according to claim 26, wherein said key pad comprises two flexible sheets, a spacer interposed between the flexible sheets, a plurality of contact electrodes formed on the first flexible sheet, and a plurality of contact electrodes formed on the second flexible sheet and opposing the contact electrodes formed on the first flexible sheet.

28. The compact wrist watch according to claim 25, wherein said case has an opening formed in the surface of the inclined portion on which said data input switch means is to be formed, and communicating with the inclined storage space section; said means for electrically connecting said electronic circuit to said battery and also to said switch means has electrodes extending from said switch means to said electronic circuit through said opening.

29. The compact wrist watch according to claim 25, wherein said data display means is mounted on said circuit board and electrically connected to said electric circuit on said circuit board to display the data output by said circuit means.

30. A compact wrist watch capable of performing calculations, said watch comprising:

circuit means including a circuit board on which an electronic circuit is formed, for measuring time, performing calculations on input data, and outputting results of the calculations;

data display means for displaying time data and the calculation results output from said circuit means;

a case made of a synthetic resin and formed integrally with a flat portion and an inclined portion inclined at a predetermined angle with respect to said flat portion, said case having a bent single storage space consisting of a flat storage space section formed in said flat portion, and an inclined storage space section formed in said inclined portion and being continuous and substantially uninterrupted with said flat storage space section, said flat storage space section containing said circuit means and said data display means such that said circuit board extends from the flat storage space section into the inclined storage spage section;

data input switch means mounted on that surface of said inclined portion which faces outwardly and in the opposite direction to a surface facing inwardly and which defines one wall of the inclined storage space section, for inputting data to said circuit means;

a battery set in said bent storage space section and being opposed to said data input switch means, for supplying power to said circuit means;

means for electrically connecting said electronic circuit on said circuit board in said inclined storage section to said battery and also to said switch means; and band means integrally formed with said case, for causing said case to fit flush with a part of the surface of a user's body.

* * * * *

UNITED STATES PATENT AND TRADEMARK OFFICE

CERTIFICATE OF CORRECTION

PATENT NO. : 4,817,065

DATED : March 28, 1989

INVENTOR(S) : Usui et al

It is certified that error appears in the above-identified patent and that said Letters Patent is hereby corrected as shown below:

In the title page, under the heading "Foreign Application Priority Data", change "60-138407" to --60-138407[U]--.

Signed and Sealed this

Second Day of January, 1990

*Attest:*

JEFFREY M. SAMUELS

*Attesting Officer*

*Acting Commissioner of Patents and Trademarks*